US009115954B1

(12) United States Patent
Corsi et al.

(10) Patent No.: US 9,115,954 B1
(45) Date of Patent: Aug. 25, 2015

(54) DOUBLE-BARRELED BULLPUP PUMP-ACTION SHOTGUN

(71) Applicant: Connecticut Shotgun Manufacturing Company, New Britain, CT (US)

(72) Inventors: Paul Joseph Corsi, Terryville, CT (US); Antony Galazan, New Britain, CT (US)

(73) Assignee: CONNECTICUT SHOTGUN MANUFACTURING COMPANY, New Britain, CT (US)

( * ) Notice: Subject to any disclaimer, the term of this patent is extended or adjusted under 35 U.S.C. 154(b) by 0 days.

(21) Appl. No.: 14/245,674

(22) Filed: Apr. 4, 2014

(51) Int. Cl.
*F41A 1/06* (2006.01)
*F41C 7/02* (2006.01)
*F41A 21/06* (2006.01)

(52) U.S. Cl.
CPC ... *F41C 7/02* (2013.01); *F41A 1/06* (2013.01); *F41A 21/06* (2013.01)

(58) Field of Classification Search
CPC ..... F41A 21/06; F41A 21/08; F41A 19/68
USPC ..... 89/126, 127, 1.41
See application file for complete search history.

(56) References Cited

U.S. PATENT DOCUMENTS 1,363,696 A * 12/1920 Thompson ..... 89/126
2,041,015 A * 5/1936 Onorati ..... 89/126
4,679,486 A * 7/1987 Landaas ..... 89/126
5,870,846 A 2/1999 Ledford

* cited by examiner

*Primary Examiner* — Stephen M Johnson
(74) *Attorney, Agent, or Firm* — Bennet K. Langlotz; Langlotz Patent & Trademark Works, Inc.

(57) ABSTRACT

A double-barreled bullpup pump-action shotgun has a frame with two forward-extending barrels arranged side-by-side, a pair of tube magazines, each positioned beneath a respective barrel, an action attached to the frame and operable to load ammunition from the tube magazines to the barrels, and a trigger assembly attached to the frame, the action being located at least in part behind the trigger assembly, and the trigger assembly including a trigger linkage to connect the trigger assembly to the action and to operate the hammers behind the bolts. The action may be a pump action. The trigger assembly may include a plurality of hammer trips, each having a sloped forward surface. The trigger assembly may include a plurality of sears having tails, and the sloped surfaces of the hammer trips may lift the tails of the sears during a portion of a complete cycle of the action.

14 Claims, 26 Drawing Sheets

DOUBLE-BARRELED BULLPUP PUMP-ACTION SHOTGUN

FIELD OF THE INVENTION

The present invention relates to firearms, and more particularly to a double-barreled bullpup pump-action shotgun with integrated actions that ensures proper simultaneous operation of both actions responsive to a single slide being pumped.

BACKGROUND OF THE INVENTION

A conventional double-barreled shotgun is a shotgun with two parallel or slightly converging barrels, which allows two shots to be fired in quick succession. The barrels can be arranged in either a side-by-side or over/under configuration. Some conventional double-barreled shotguns use two triggers, one for each barrel. These are commonly located front to back inside the trigger guard, with the index finger being used to pull either trigger. This approach has the disadvantage that some users struggle to fire two triggers quickly, especially in stressful situations. Instead, they pull the same trigger twice in error, which results in only one round being fired. To address this problem, other conventional double-barreled shotguns use a single trigger that alternately fires both barrels, called a Single Trigger (ST). The ST does not allow firing both barrels at once; the single trigger must be pulled twice in order to fire both barrels. The change from one barrel to the other while shooting may be done by a clockwork type system, where a cam alternates between barrels, or by an inertial system, where the recoil of firing the first barrel toggles the trigger to the next barrel.

The term "bullpup" describes a firearm configuration in which the action is located behind the trigger group and alongside the shooter's face, so there is no wasted space for the buttstock as in conventional designs. This permits a shorter firearm length for the same barrel length for improved maneuverability, and reduces weight. Because the trigger group is positioned in front of the action, a trigger linkage is required to connect the trigger group to the action.

A conventional pump-action shotgun is one in which the handgrip or forend can be pumped back and forth in order to cycle the action to eject a spent round of ammunition and to chamber a fresh one. A pump-action shotgun is typically fed from a tubular magazine underneath the barrel, which also serves as a guide for the movable forend. The rounds are fed in one by one through a port in the receiver, where they are lifted by a lever called the shell carrier and are pushed forward into the chamber by the bolt. A pair of latches at the rear of the magazine hold the rounds in place and facilitate feeding of one shell at a time.

The forend is connected to the bolt by one or two bars (two bars are considered more reliable because they provide symmetric forces on the bolt and pump and reduce the chances of binding). The motion of the bolt back and forth in a tubular magazine model will also operate the shell carrier, which lifts the shells from the level of the magazine to the level of the barrel. Modern pump-action shotgun designs have a safety feature called a trigger disconnector, which disconnects the trigger from the sear as the bolt moves back, so that the trigger must be released and pulled again to fire the shotgun after it closes.

After firing a round, the bolt is unlocked and the forend is free to move. The shooter pulls back on the forend to begin the operating cycle. The bolt unlocks and begins to move to the rear, which extracts the empty shell from the chamber, cocks the hammer, and lowers the carrier to eject empty shell and to align its lifting forks to the magazine tube. In a tubular magazine design, as the bolt reaches the rear, a single shell is released from the magazine, and is pushed backwards to come to rest on the shell carrier forks.

As the forend begins to move forward, the shell carrier lifts up the shell, lining it up with the barrel chamber. As the bolt moves forward, the round slides into the chamber, and the final portion of the forend's travel locks the bolt into position. A pull of the trigger will fire the next round, where the cycle begins again.

An example of a double-barreled shotgun that allows both actions to be actuated together by a pair of forearm members when the forearm members are pumped simultaneously is U.S. Pat. No. 5,870,846 to Ledford. Ledford permits the forearm members to be pumped individually so that only a single barrel is reloaded. However, this is disadvantageous when the user is trying to pump both forearm members simultaneously. If both forearm members are not pulled back fully so that the action fully cycles, one side could fail to eject the spent round from the breech and fail to load the next round. The preferred embodiment features two triggers located front to back within the trigger guard, with the associated disadvantages associated noted previously. Ledford discloses that optionally, a single trigger mechanism may be used to fire one or both shells at a time. Since Ledford ejects spent shells from the sides, there is a risk of the shooter being hit in the face by an ejecting shell. This risk would be magnified if Ledford were to somehow be converted into a bullpup configuration with a shortened buttstock.

Therefore, a need exists for a new and improved double-barreled bullpup pump-action shotgun with integrated actions that ensures proper simultaneous operation of both actions responsive to a single slide being pumped. In this regard, the various embodiments of the present invention substantially fulfill at least some of these needs. In this respect, the double-barreled bullpup pump-action shotgun according to the present invention substantially departs from the conventional concepts and designs of the prior art, and in doing so provides an apparatus primarily developed for the purpose of having integrated actions that ensures proper simultaneous operation of both actions responsive to a single slide being pumped. The integrated action ejecting and loading two rounds with every slide pump allows for instant safety redundancy if the first action does not fire.

SUMMARY OF THE INVENTION

The present invention provides an improved double-barreled bullpup pump-action shotgun, and overcomes the above-mentioned disadvantages and drawbacks of the prior art. As such, the general purpose of the present invention, which will be described subsequently in greater detail, is to provide an improved double-barreled bullpup pump-action shotgun that has all the advantages of the prior art mentioned above.

To attain this, the preferred embodiment of the present invention essentially comprises a frame with two forward-extending barrels arranged side-by-side, a pair of tube magazines, each positioned beneath a respective barrel, an action attached to the frame and operable to load ammunition from the tube magazines to the barrels, and a trigger assembly attached to the frame, the action being located at least in part behind the trigger assembly, and the trigger assembly including a trigger linkage to connect the trigger assembly to the action and to operate the hammers behind the bolts. The action may be a pump action. The trigger assembly may include a plurality of hammer trips, each having a sloped forward surface. The trigger assembly may include a plurality of sears having tails, and the sloped surfaces of the hammer trips may lift the tails of the sears during a portion of a complete cycle of the action.

There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
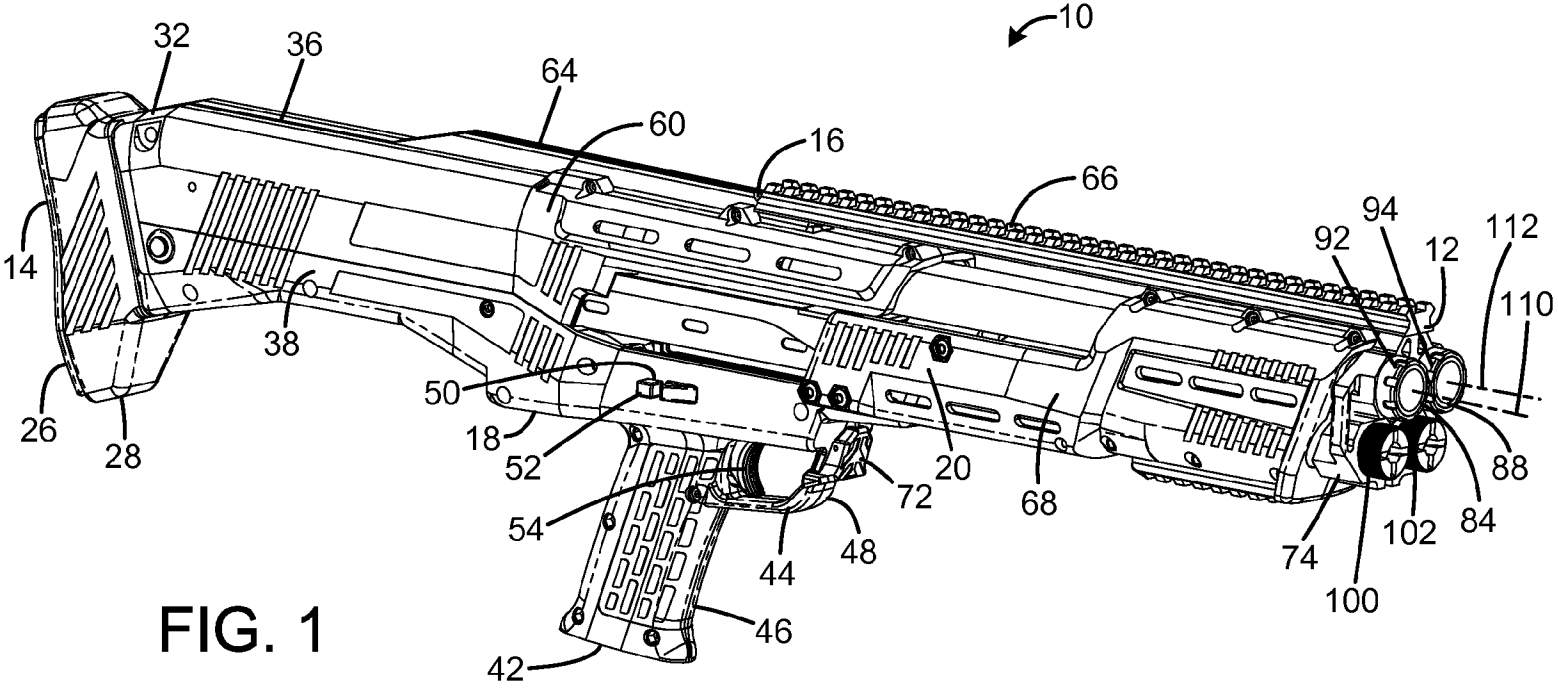
FIG. 1 is a right isometric view of the current embodiment of the double-barreled bullpup pump-action shotgun constructed in accordance with the principles of the present invention.
Figure 2:
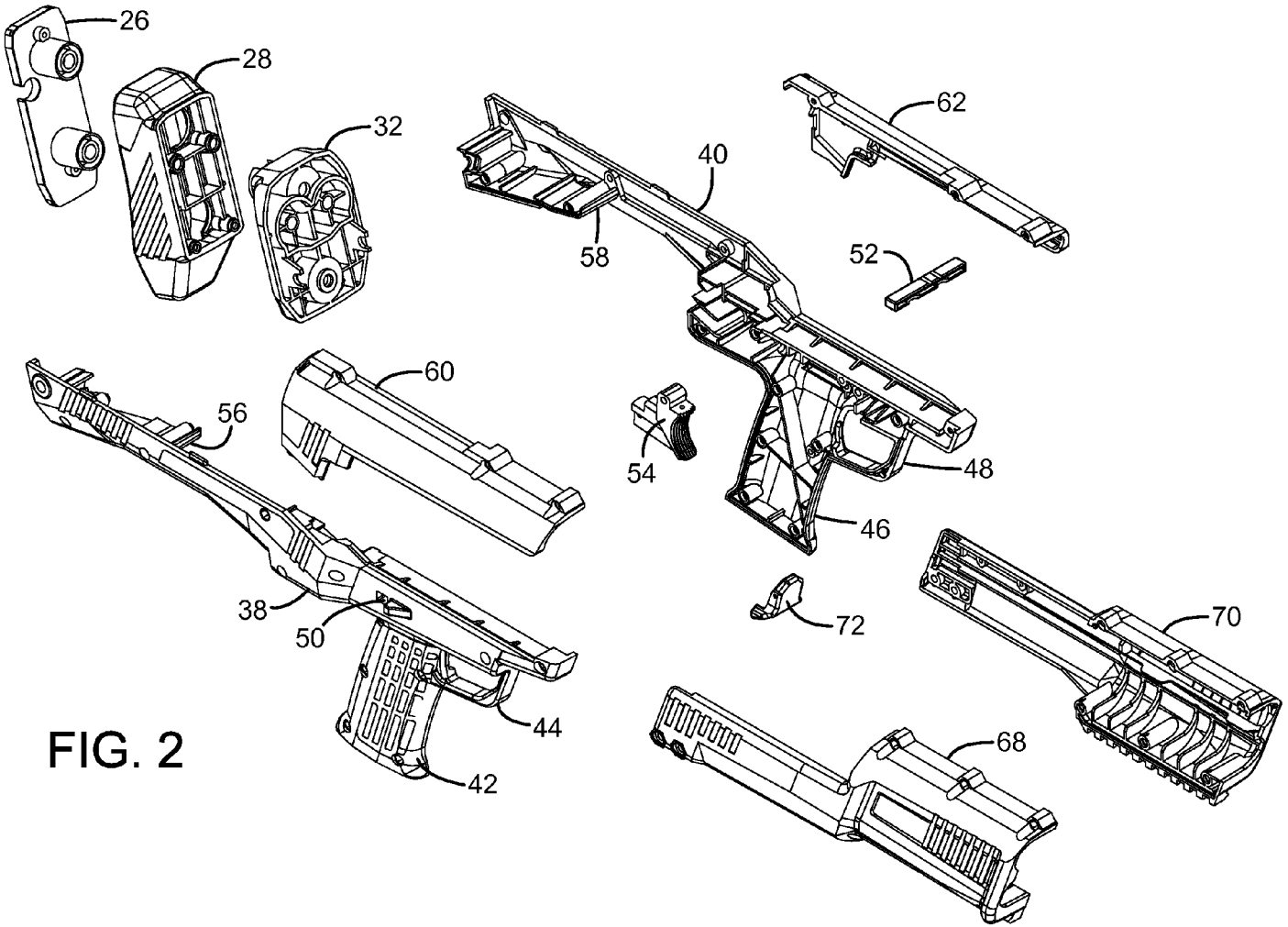
FIG. 2 is an exploded view of the molded housings of the current embodiment of the double-barreled bullpup pump-action shotgun of FIG. 1.
Figure 3:
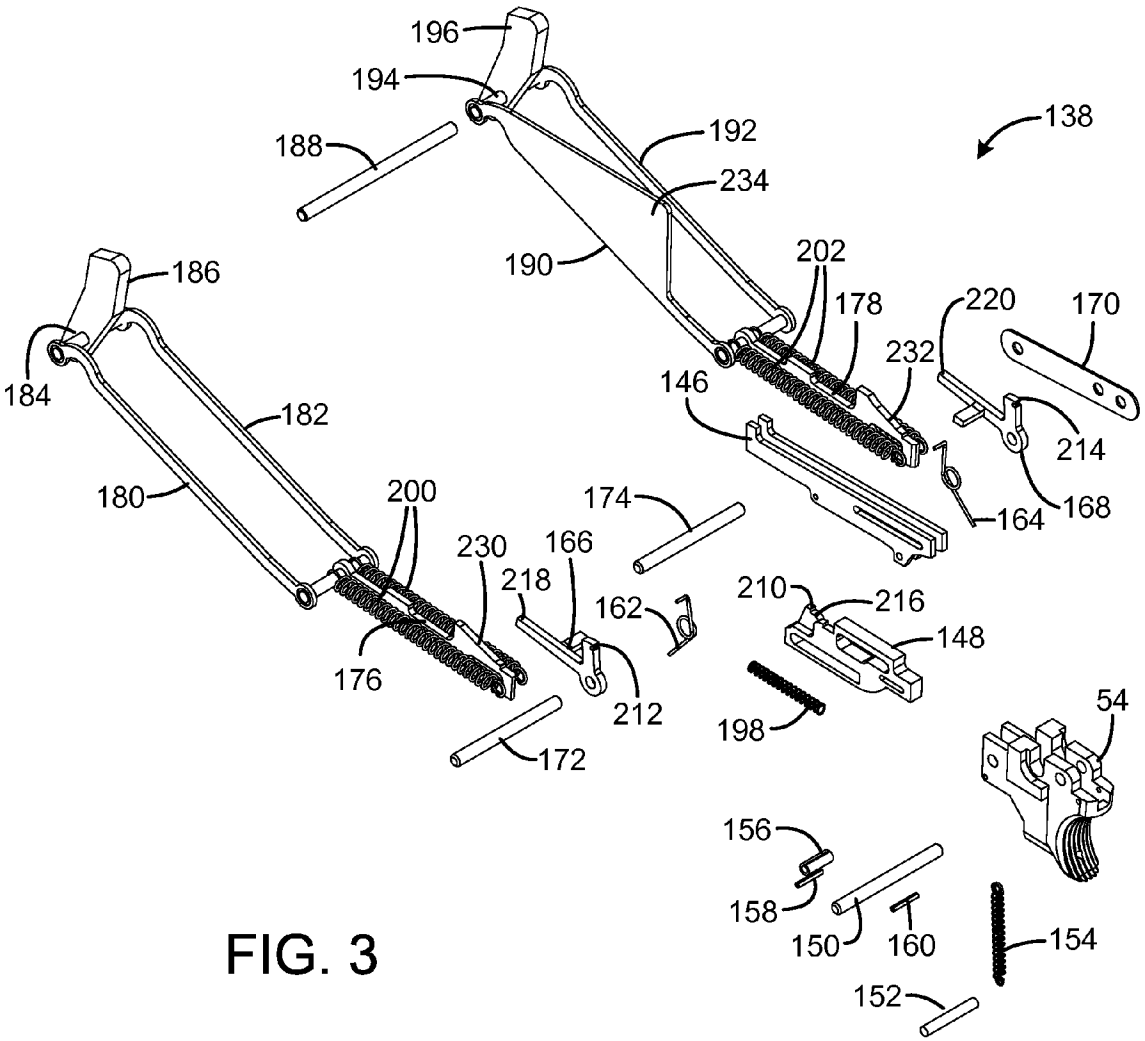
FIG. 3 is an exploded view of the current embodiment of a trigger assembly and hammer linkages constructed in accordance with the principles of the present invention.
Figure 4:
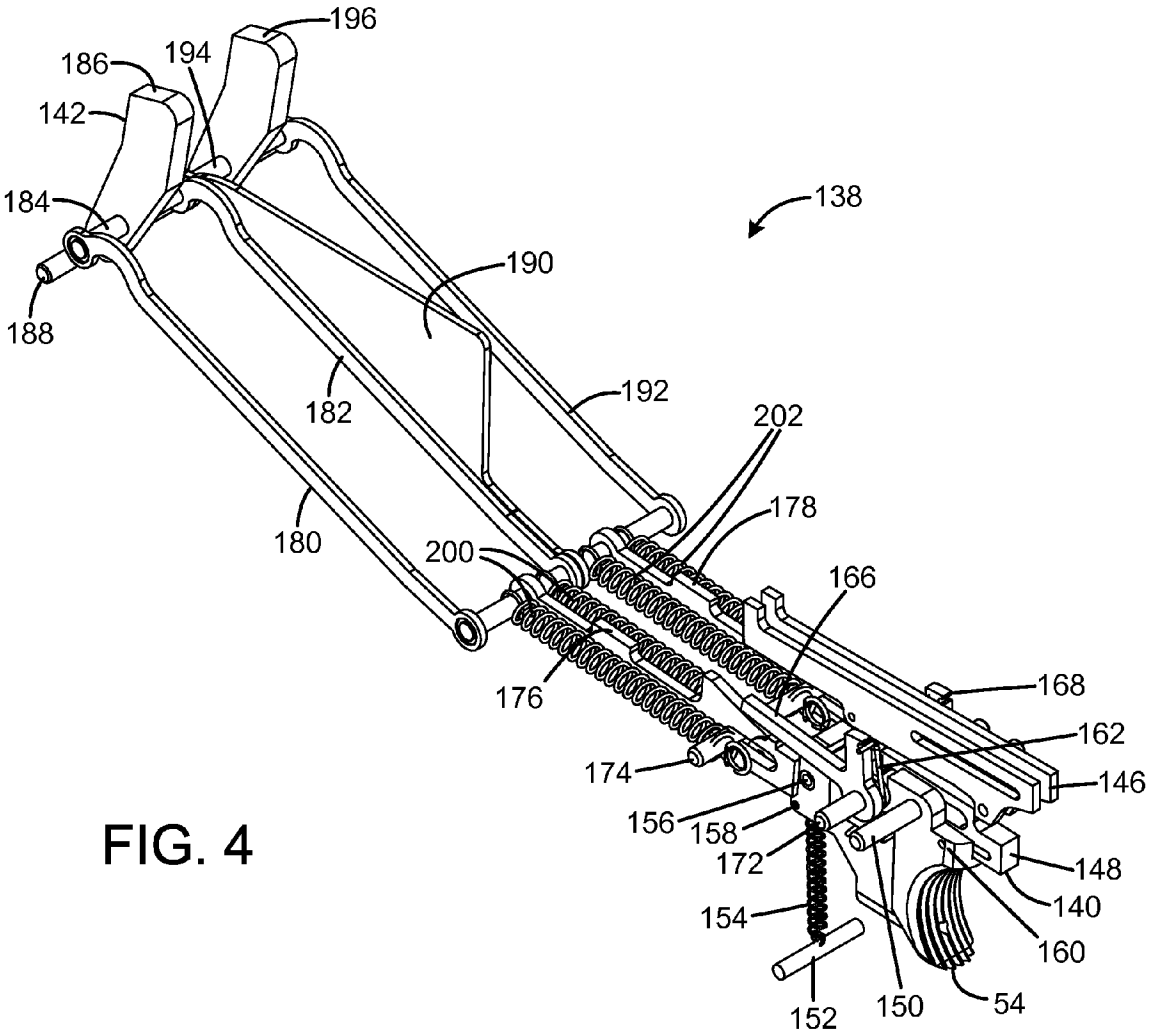
FIG. 4 is a right isometric view of the current embodiment of the trigger assembly and hammer linkages of FIG. 3.
Figure 5A:
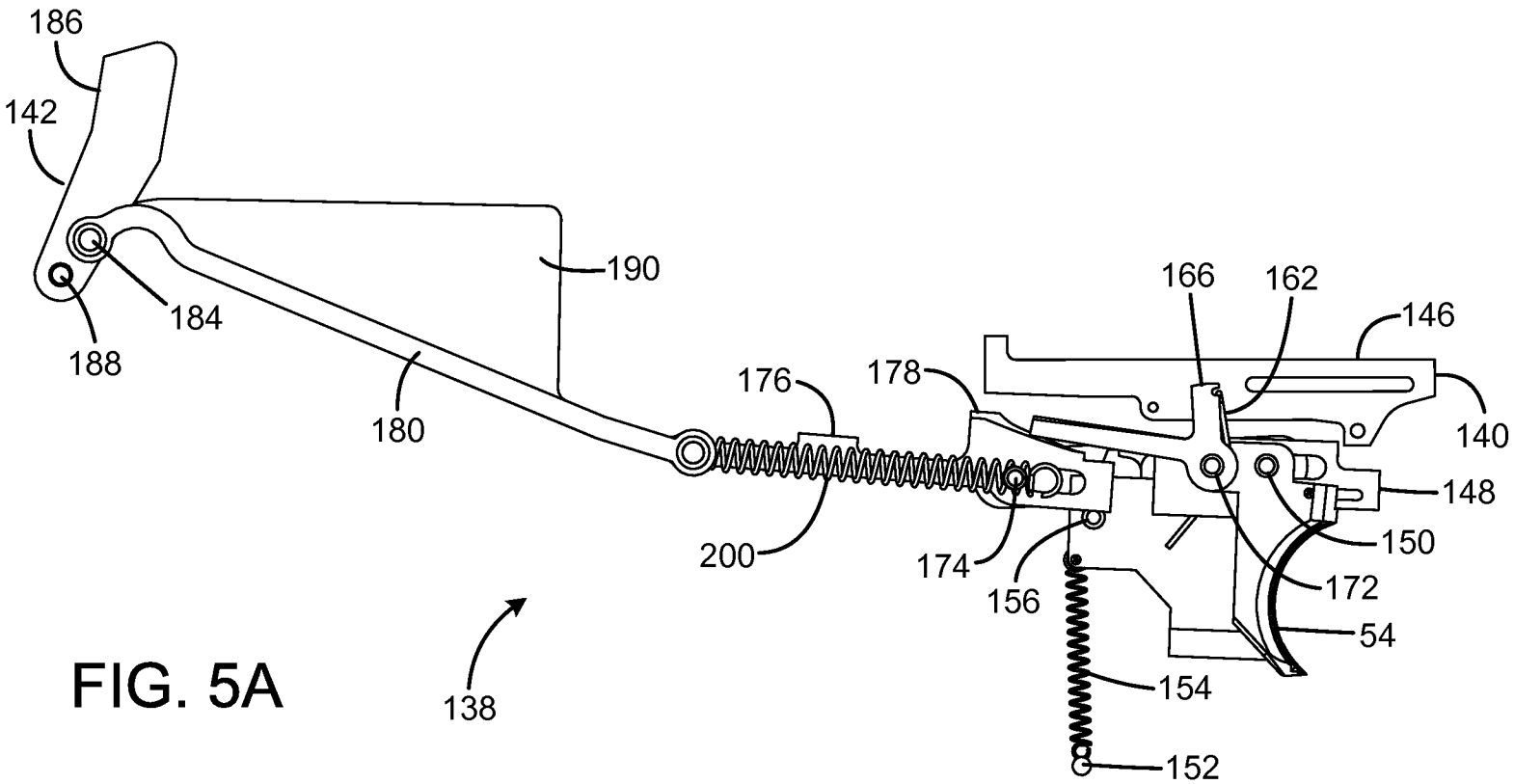
FIG. 5A is a right side view of the current embodiment of the trigger assembly and hammer linkages of FIG. 3.
Figure 5B:
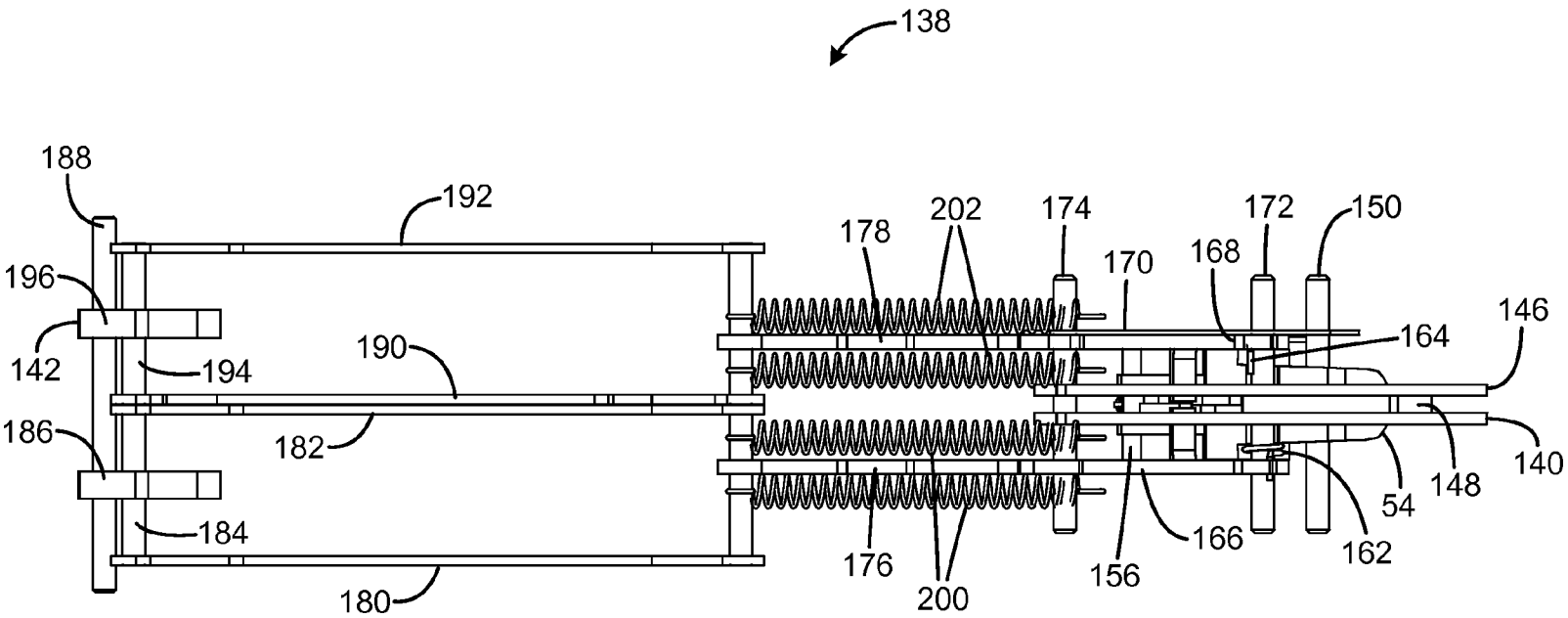
FIG. 5B is a top view of the current embodiment of the trigger assembly and hammer linkages of FIG. 3.
Figure 6:
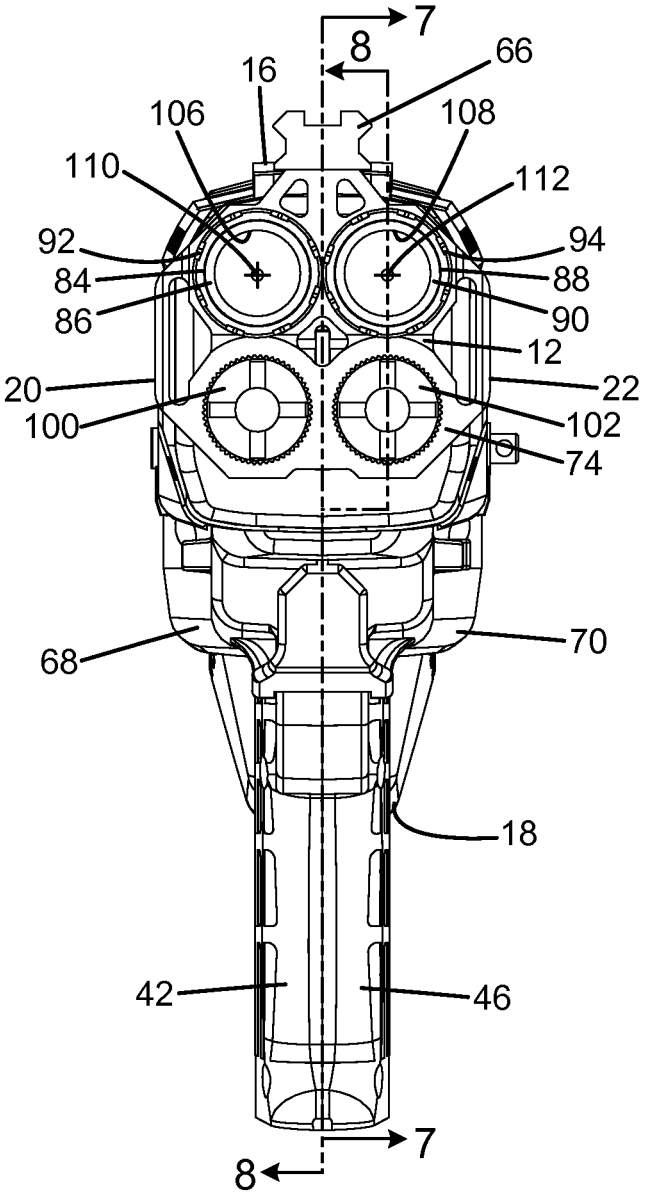
FIG. 6 is a front view of the current embodiment of the double-barreled bullpup pump-action shotgun of FIG. 1.

An embodiment of the double-barreled bullpup pump-action shotgun of the present invention is shown and generally designated by the reference numeral 10.

FIGS. 1, 2, & 6-8 illustrate the improved double-barreled bullpup pump-action shotgun 10 of the present invention. More particularly, the double-barreled bullpup pump-action shotgun has a front 12, rear 14, top 16, bottom 18, right side 20, and left side 22. A recoil pad 24 and recoil plate 26 are attached to a recoil pad shroud 28 by two screws 30. The recoil pad shroud is attached to a recoil shroud support 32 by two bolts 34 that are threadedly engaged with a frame/receiver 36. A right housing 38 and a left housing 40 are attached beneath the receiver and extend in front of the receiver. The right housing has a downwardly protruding right pistol grip 42 and a right trigger guard 44. The left housing has a downwardly protruding left pistol grip 46 and a left trigger guard 48. A safety 52 protrudes from an aperture 50 located above the right pistol grip in the right housing. A trigger 54 is received within the right and left trigger guards. The right and left housings defining a right ejection port 56 and left ejection port 58 that is located rearward of the right and left pistol grips.

A right barrel shroud 60 and a left barrel shroud 62 are attached to the right housing 38 and left housing 40 above the right pistol grip 42 and left pistol grip 46. A sight bar 64 is attached to the top 16 of the receiver 36 by two screws 80, 82, and an accessory rail 66 is attached to the top of the receiver in front of the sight bar by a screw 78. A right forend 68 and a left forend 70 are slidably attached in front of the right and left housings. An action release button 72 is attached to the internal release bar 136 immediately in front of the right trigger guard 44 and left trigger guard 48. A barrel muzzle support 74 is attached by a screw 76 to the accessory rail.

The barrel muzzle support 74 has four apertures. The top two apertures receive the right muzzle 84 of a right barrel 86 and the left muzzle 88 of a left barrel 90. This barrel configuration makes the shotgun 10 a side-by-side double-barreled shotgun. The muzzles of the barrels are secured to the barrel support by a right muzzle nut 92 and a left muzzle nut 94. The bottom two apertures of the barrel muzzle support receive the right magazine tube 96 and left magazine tube 98, which are each positioned beneath a respective barrel. The front open ends of the right and left magazine tubes are closed by a right magazine cap 100 and a left magazine cap 102. Each magazine tube receives a magazine spring (the left magazine spring 104 is shown in FIGS. 8 and 30B).

The right and left barrels 86, 90 each have a central bore 106, 108 that defines a right barrel axis 110 and left barrel axis 112. The rear 14 portions of the barrels define a right chamber 114 and a left chamber 116. In order to make the shotgun 10 as compact as possible, it is desirable to minimize the distance between the right and left barrel axes. To accomplish this, a portion of the exterior of the barrels is shaved away (the left barrel shaved portion 118 is visible in FIG. 7) to form a flat surface portion facing the other barrel near the chambers where the barrels achieve their maximum width such that the flat surface portions abut each other. The shaved barrel portions enable the right and left muzzles 84, 86 to be as close together as possible while still permitting the right and left muzzle nuts 92, 94 to rotate. In the current embodiment, the aft or rear portions of the barrels each have a cylindrical exterior surface portion having a first radius of preferably 0.617 inch, and the barrel axes are spaced apart by less than two times the first radius (preferably 1.100 inches). The aft or rear portions of the barrels each have a sidewall thickness of a first thickness amount (preferably 0.213 inch) at the cylindrical exterior surface portion and a sidewall thickness of a lesser second thickness (preferably.146 inch) at a portion of the aft portion shaved for the other barrel. In the current embodiment, the barrels are chambered for a 12 gauge shell.

Figure 7:
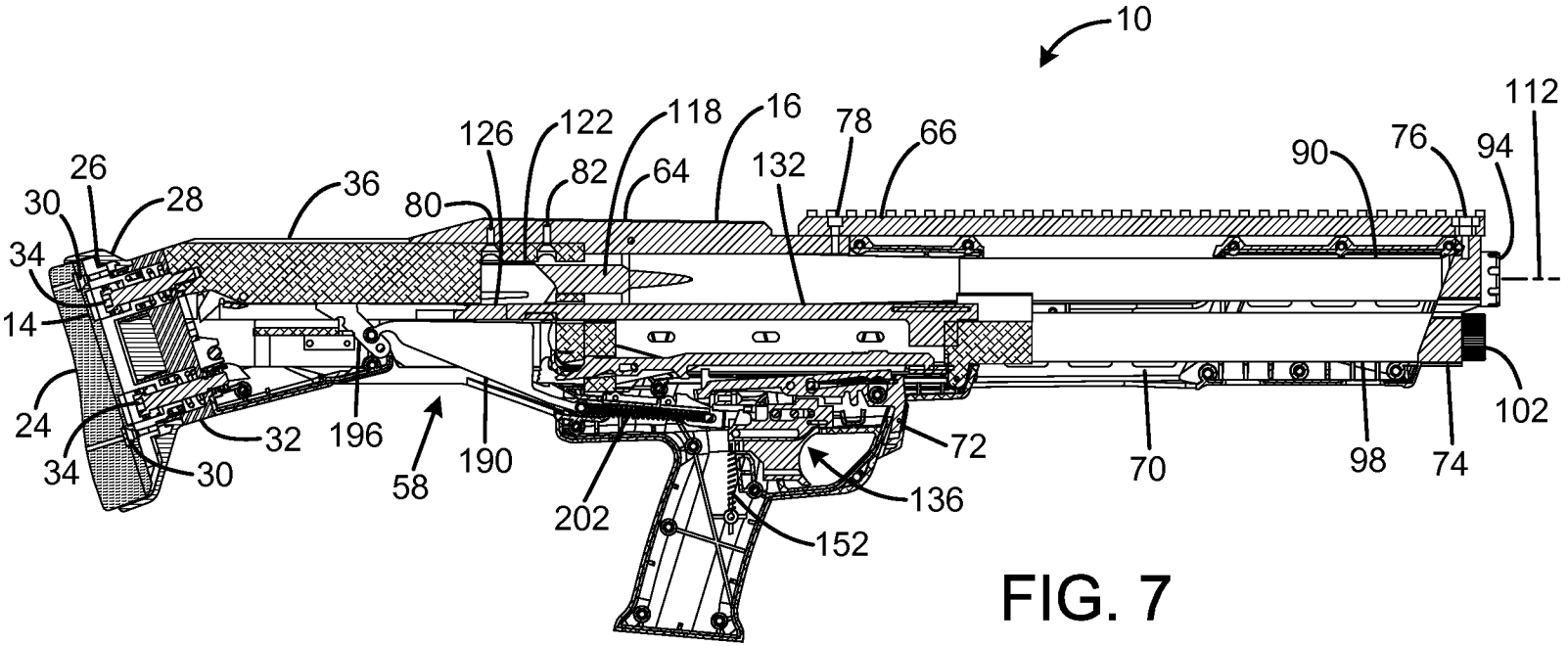
FIG. 7 is a right side sectional view of the current embodiment of the double-barreled bullpup pump-action shotgun of FIG. 1 taken along line 7-7 of FIG. 6.
Figure 8:
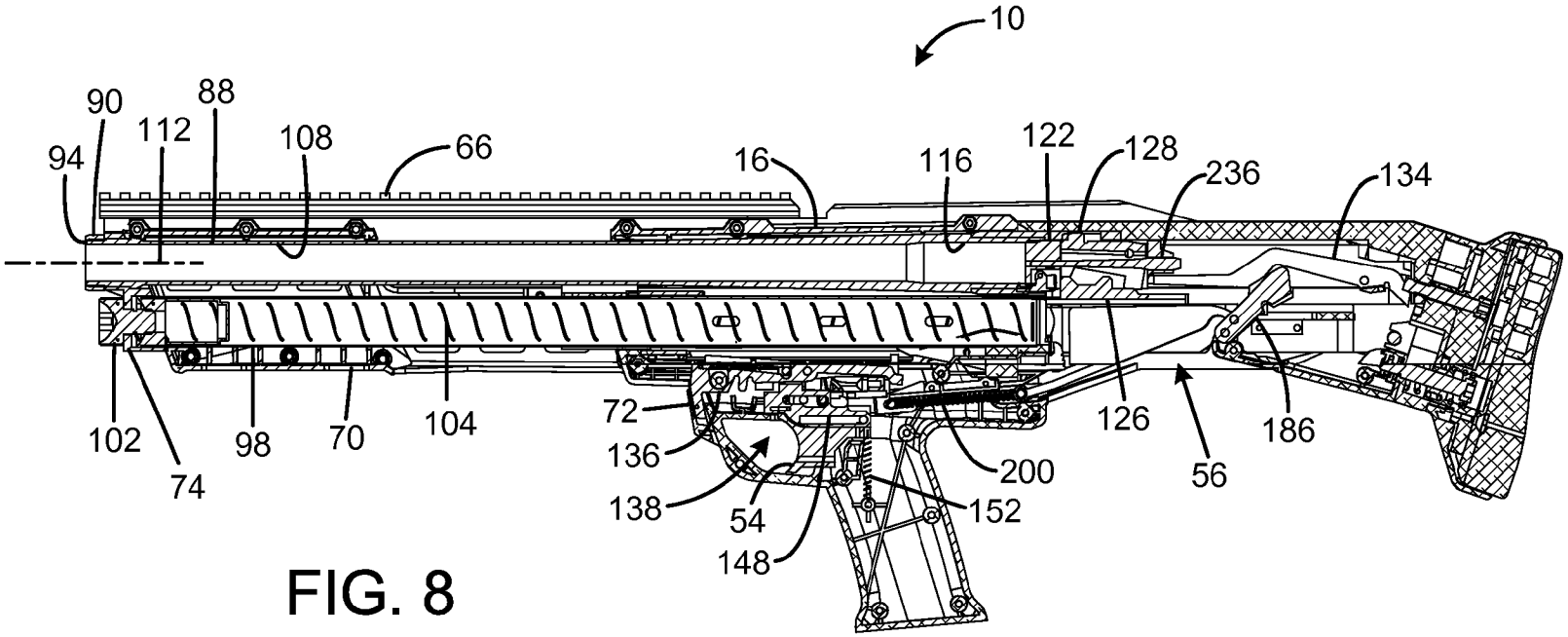
FIG. 8 is a left side sectional view of the current embodiment of the double-barreled bullpup pump-action shotgun of FIG. 1 taken along line 8-8 of FIG. 6.

Right and left bolts 120, 122 having right and left bolt locks (left bolt lock 128 is shown in FIG. 8) and right and left bolt slides 124, 126 received within the receiver 36 behind the right and left chambers 114, 116. The right and left bolt slides are integrated into one piece and cannot move independently. The right and left bolts are axially registered with the right and left barrel axes 110, 112. Each bolt receives a firing pin (the right firing pin 130 is shown in FIG. 30C, and the left firing pin 236 is shown in FIGS. 8 and 30C). Right and left shell release actuators are located below the right and left barrels 88, 90 and right and left bolts (the left shell release actuator 132 is shown in FIG. 7). Right and left shell carriers (the left shell carrier 134 is shown in FIG. 8, and the right shell carrier 202 is visible in FIG. 9) are pivotally attached to the receiver behind the right and left bolts. A trigger assembly 138 is contained within the right and left housings 38, 40 and will be discussed in detail in the description of FIGS. 3-5B. The action is located at least in part behind the trigger assembly.

FIGS. 3-5B illustrate the improved trigger assembly 138 of the present invention uninstalled from the double-barreled bullpup pump-action shotgun 10. More particularly, the trigger assembly has a front 140 and rear 142. The right hammer 186 and left hammer 196 are pivotally connected to opposed ends of a hammer pivot 188. One end of a right hammer link 180 and a left hammer link 182 are attached to the right hammer by opposed ends of a right hammer link pin 184. The opposed end of the right and left hammer link 180, 182 are connected to one end of a right hammer trip 176. The right hammer trip has a forward sloped surface 230. One end of an elongated hammer link divider 190 and a left hammer link 192 are attached to the left hammer 196 by opposed ends of a left hammer link pin 194. The hammer link divider has a broad triangular portion 234. The opposed end of the hammer link divider and left hammer link 190, 102 are connected to one end of a left hammer trip 178. The left hammer trip has a forward sloped surface 232. The opposed end of the right hammer trip is connected to the opposed end of the left hammer trip and an assembly pin plate 170 by a main spring pin 174.

Figure 13:
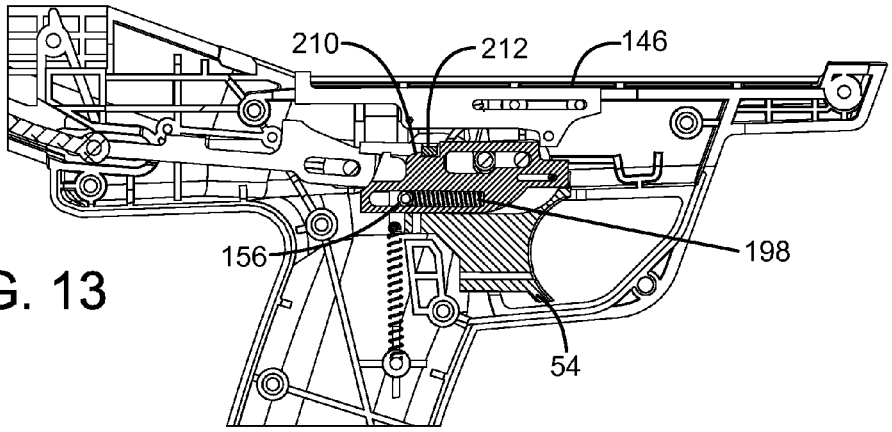
FIG. 13 is an enlarged partial view of the current embodiment of the trigger assembly of FIG. 10 taken along line 13 of FIG. 12 with the trigger selector bar rearward, ready to lift the right sear.

A selector stop trigger pin 156 is connected to the trigger 54 to limit rearward movement of a selector bar 148. A small roll pin 158 connects the trigger to one end of a trigger return spring 154. The opposed end of the trigger return spring is attached to a trigger return spring pin 152. A right sear 166, a right sear torsion spring 162, a left sear 168, and a left sear torsion spring 164 are connected to the trigger and the assembly pin plate 170 by a sear/trigger pin 172. A small roll pin 160 connects the selector bar 148 to the trigger, and a sear/trigger pin 150 connects the selector bar and the trigger to the assembly pin plate. The selector bar spring 198 is received within the selector bar (shown in FIG. 13). The right and left hammer springs 200, 202 are connected to the rear hammer link and the main spring pin.

Figure 9:
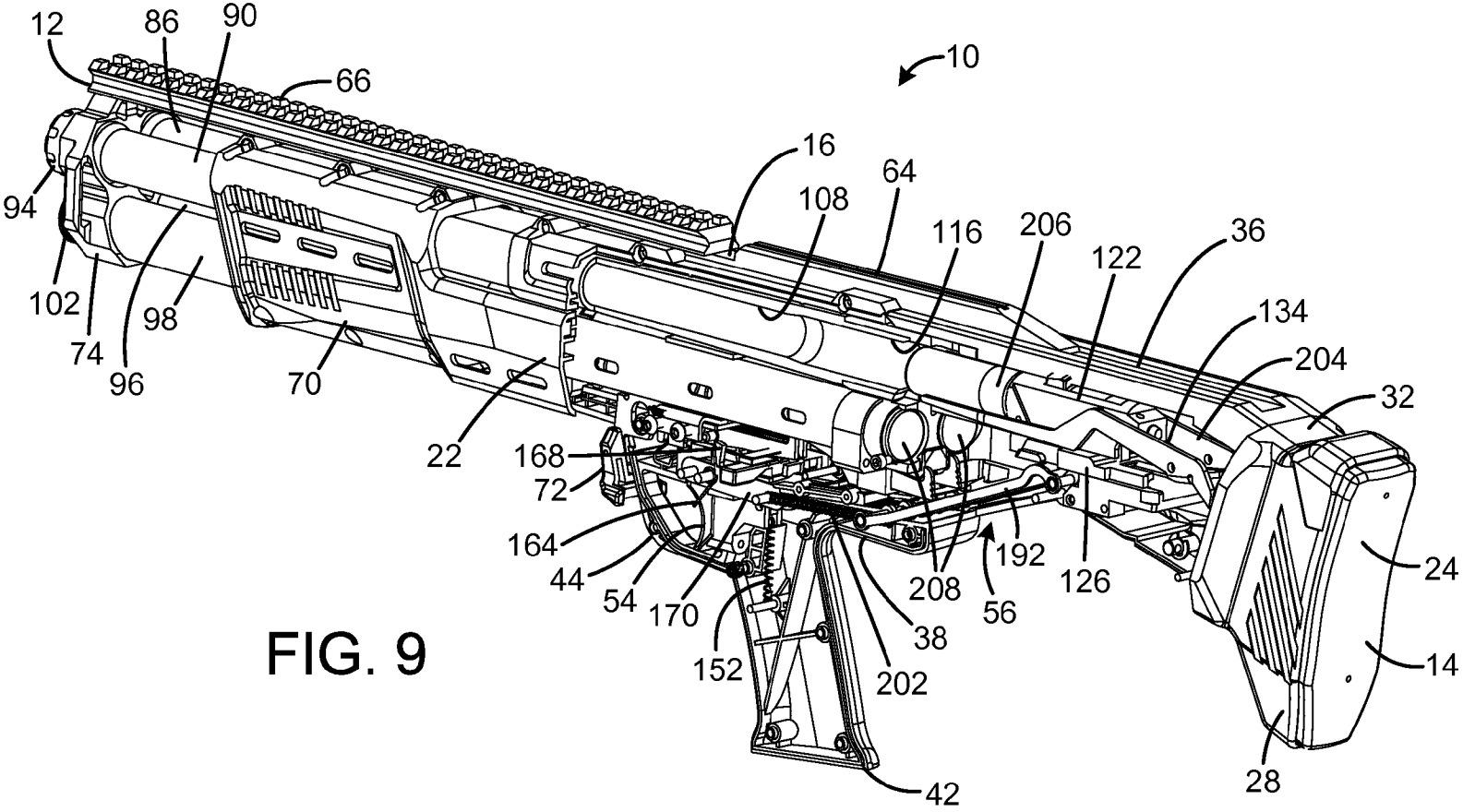
FIG. 9 is a rear isometric cutaway view of the current embodiment of the double-barreled bullpup pump-action shotgun of FIG. 1 with a shell entering the chamber.

FIGS. 9-31 illustrate the improved double-barreled bullpup pump-action shotgun 10. More particularly, the shotgun 10 is shown going through a complete cycle of loading an initial pair of shells, discharging the shells, ejecting the spent shells, and reloading the next pair of shells. In FIG. 9, the left rear of the shotgun is cutaway. The right and left shell carriers 204, 134 are lifting shells 206 from the right and left magazine tubes 96, 98 up to the right and left chambers 114, 116 as the right and left forends 68, 70, which are joined, move forward from their rearmost position. As the shells reach the level of the chambers, the right and left bolts 120, 122 begin to close. As the bolts close, they urge the shells forward into the chambers. The forward movement of the shells is guided by the shell carriers, which are mounted behind the right and left bolt slides 124, 126. The shells 208 that will be loaded next are visible protruding rearwardly from the right and left magazine tubes.

Figure 10:
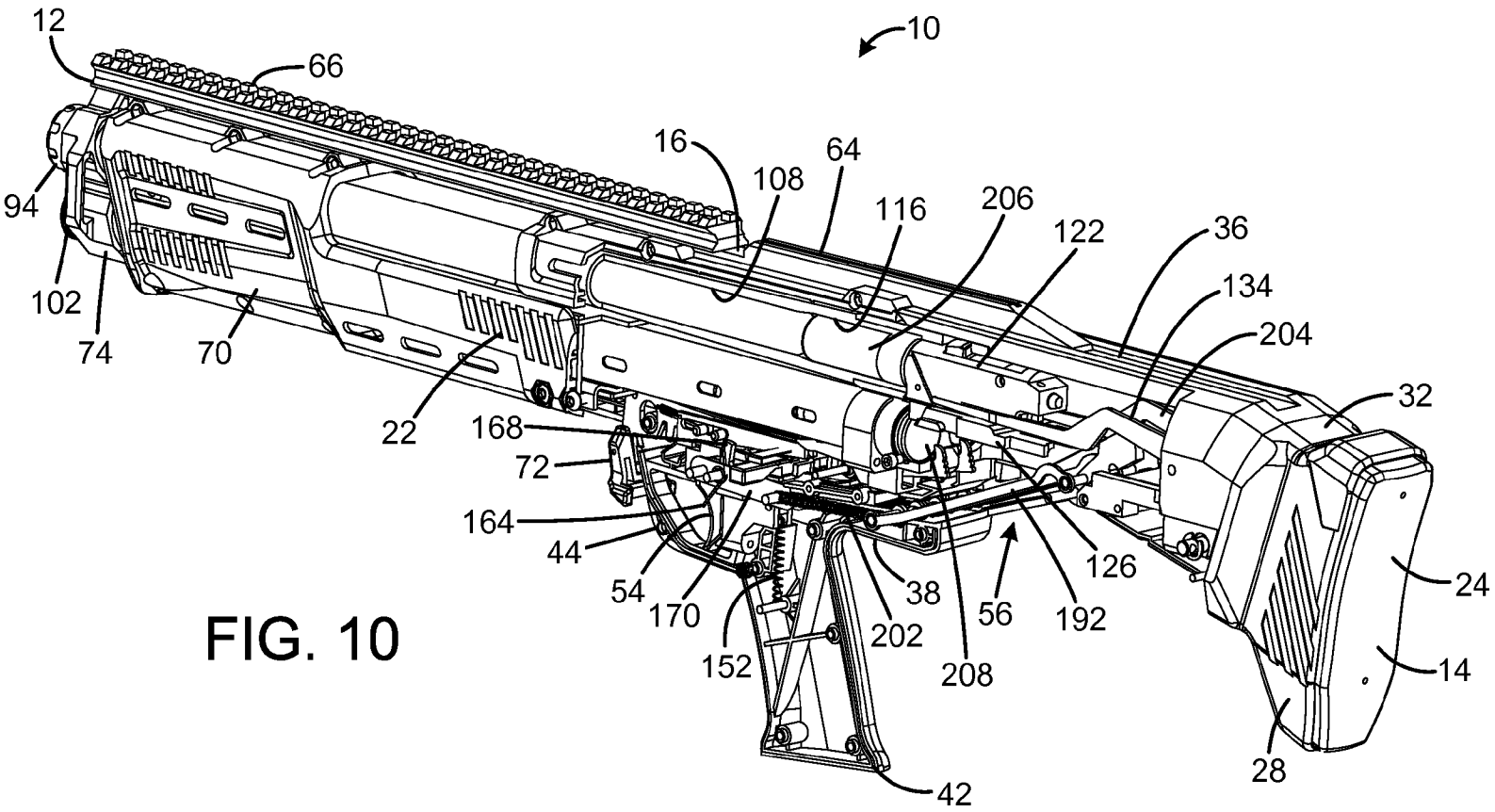
FIG. 10 is a rear isometric cutaway view of the current embodiment of the double-barreled bullpup pump-action shotgun of FIG. 1 with a shell chambered and the bolt closed.
Figure 11:
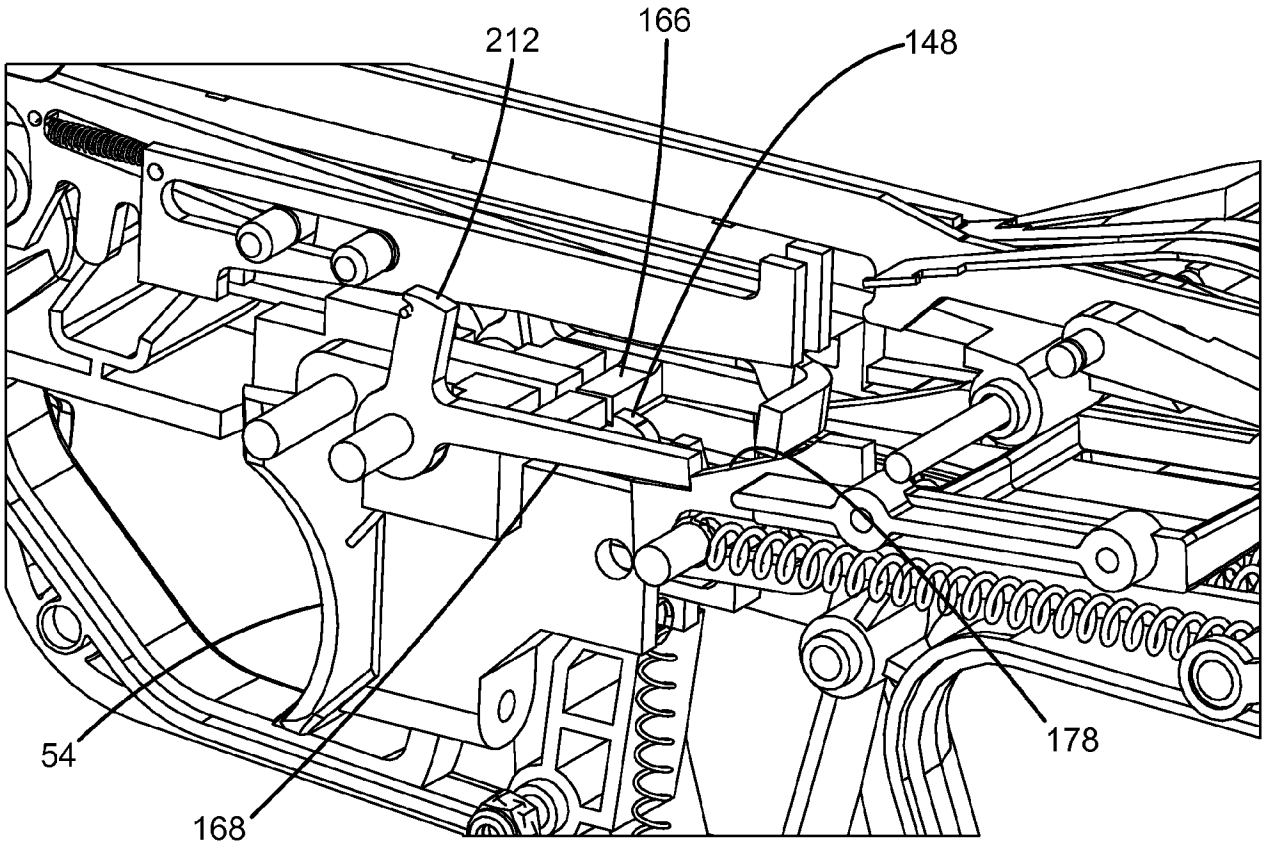
FIG. 11 is an enlarged view of the current embodiment of the trigger assembly of FIG. 10 with the left hammer and right hammer cocked.
Figure 12:
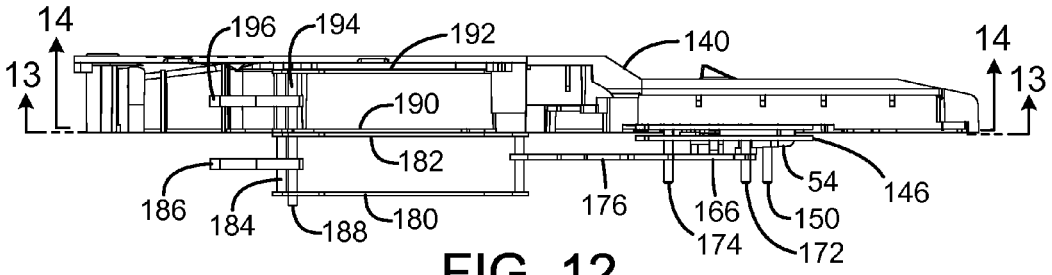
FIG. 12 is a top cutaway view of the current embodiment of the trigger assembly of FIG. 10.

In FIG. 10, the left rear of the shotgun 10 is cutaway. The shells 206 are received in the right and left chambers 114, 116, the right and left bolts 120, 122 are closed and locked, and the right and left forend 68, 70, which are joined, have moved forward into their forwardmost position. The right and left shell carriers 204, 134 have pivoted downward relative to their position in FIG. 9.

Figure 14:
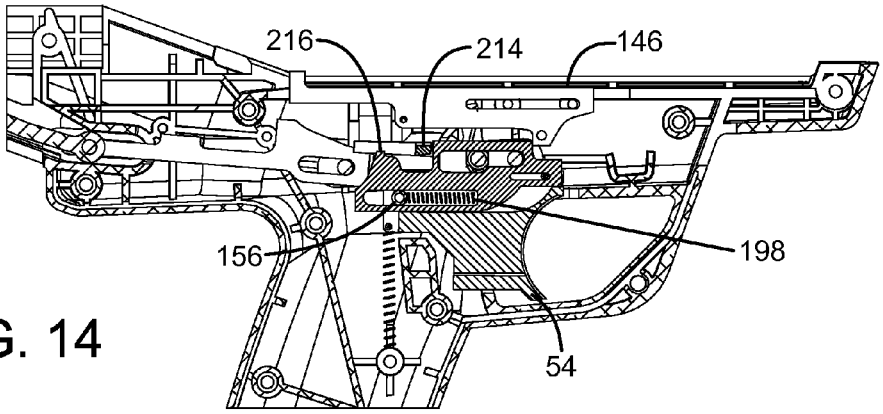
FIG. 14 is an enlarged partial view of the current embodiment of the trigger assembly of FIG. 10 taken along line 14 of FIG. 12 with the trigger selector bar rearward so the trigger cannot activate the left sear.
Figure 15:
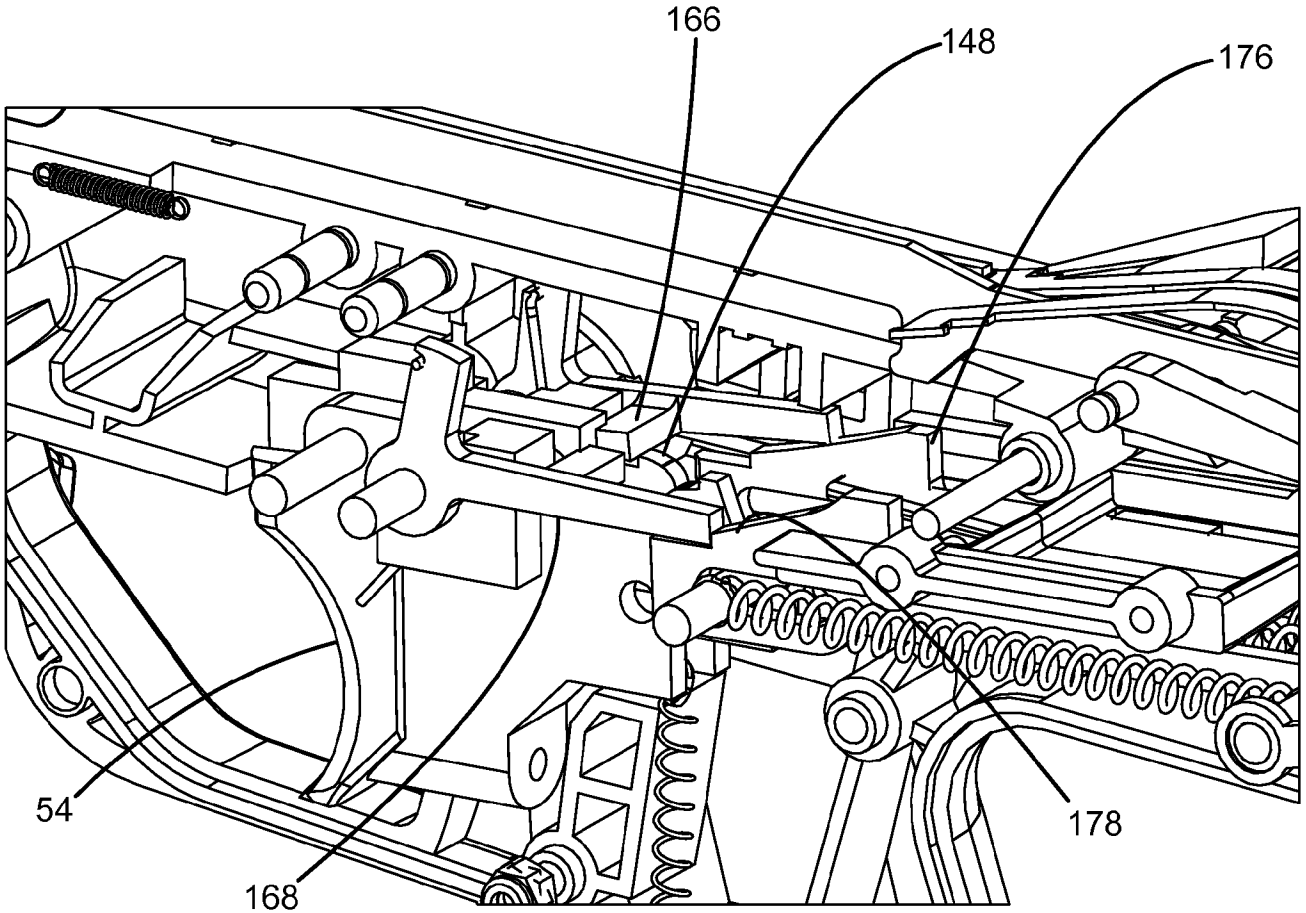
FIG. 15 is an enlarged view of the current embodiment of the trigger assembly after the trigger has been pulled, the right side sear has lifted, and the right shell has fired.
Figure 16:
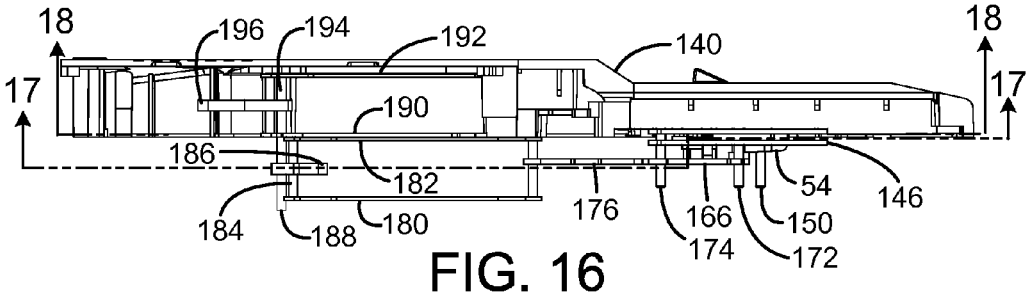
FIG. 16 is a top cutaway view of the current embodiment of the trigger assembly of FIG. 15 after the trigger has been pulled and the right side shell has fired.
Figure 17:
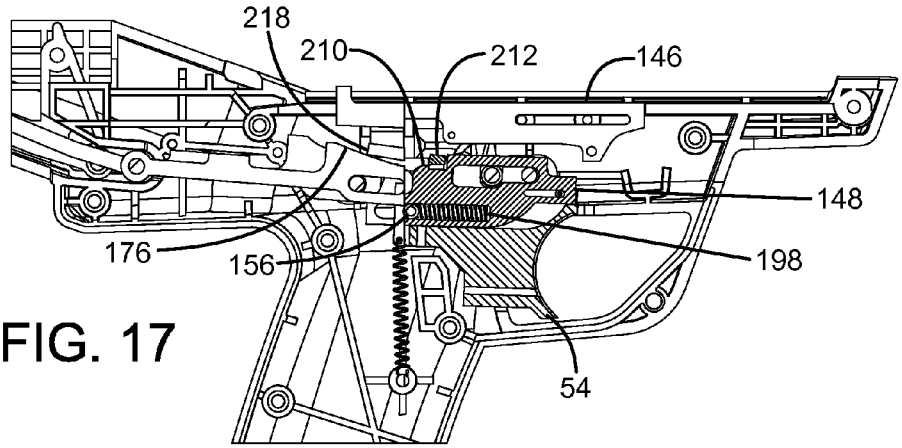
FIG. 17 is an enlarged partial view of the current embodiment of the trigger assembly of FIG. 15 taken along line 17 of FIG. 16.
Figure 18:
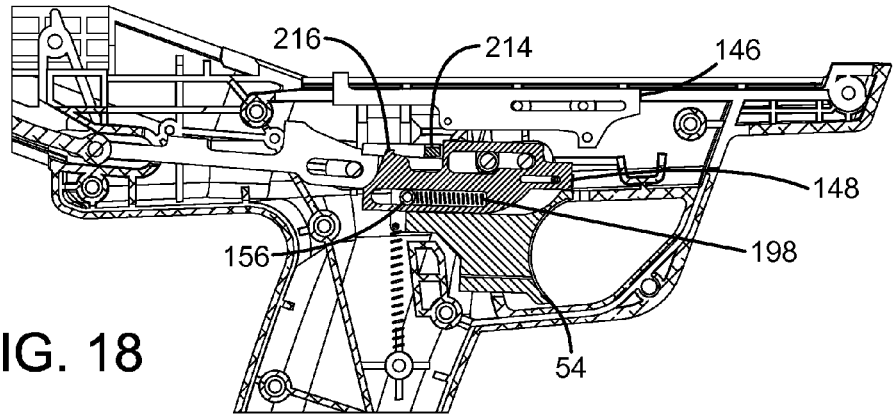
FIG. 18 is an enlarged partial view of the current embodiment of the trigger assembly of FIG. 15 taken along line 18 of FIG. 16.
Figure 19:
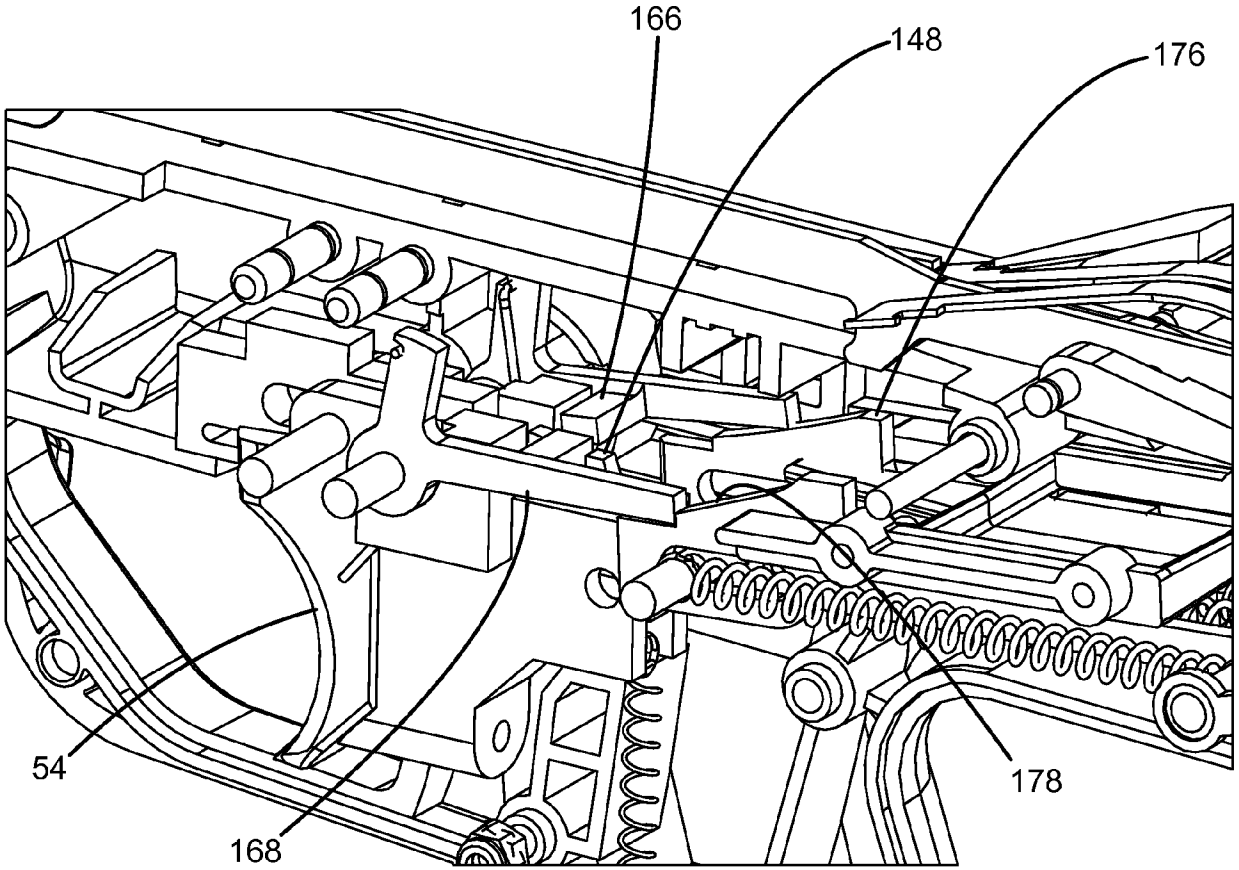
FIG. 19 is an enlarged view of the current embodiment of the trigger assembly with the trigger ready to lift the left sear to fire the left shell.
Figure 20:
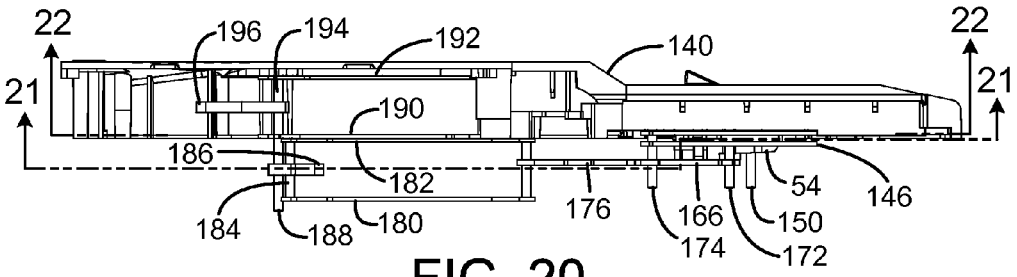
FIG. 20 is a top cutaway view of the current embodiment of the trigger assembly of FIG. 19 with the trigger ready to fire the left shell.
Figure 21:
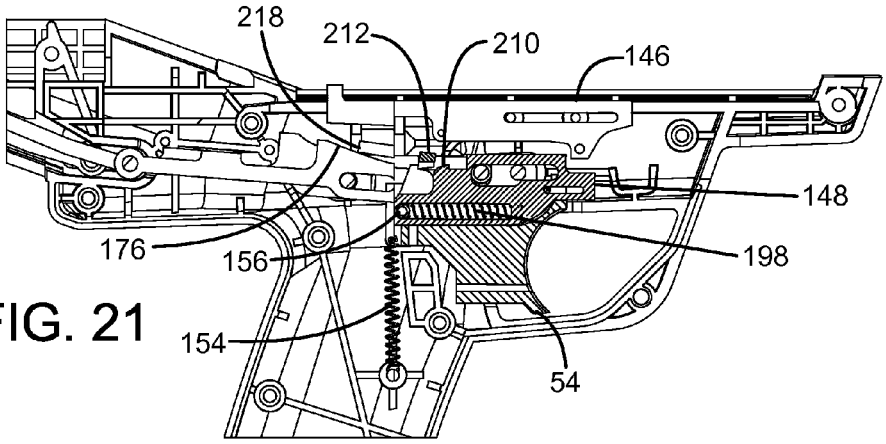
FIG. 21 is an enlarged partial view of the current embodiment of the trigger assembly of FIG. 19 taken along line 21 of FIG. 20 with the trigger selector bar forward, ready to lift the left sear.
Figure 22:
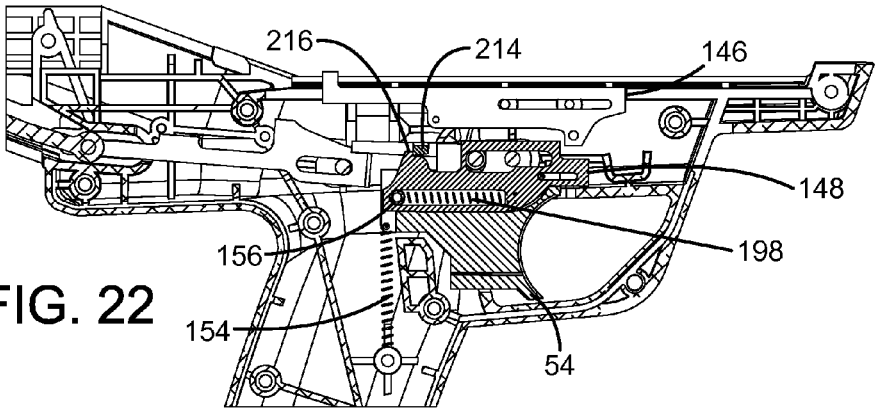
FIG. 22 is an enlarged partial view of the current embodiment of the trigger assembly of FIG. 19 taken along line 21 of FIG. 20 with the trigger selector bar forward, ready to lift the left sear.
Figure 23:
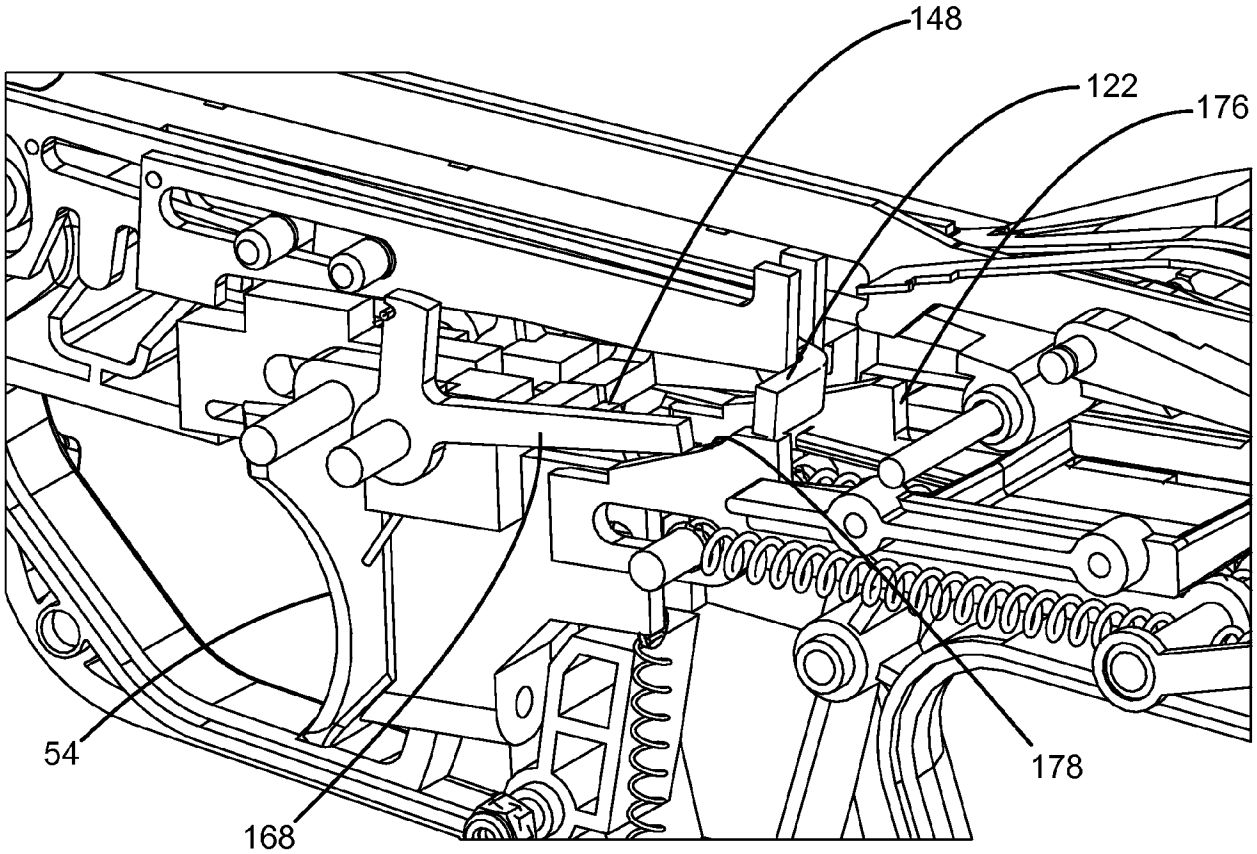
FIG. 23 is an enlarged view of the current embodiment of the trigger assembly after the trigger has been pulled a second time and the left side shell has fired before moving the forend rearward to cock.
Figure 24:
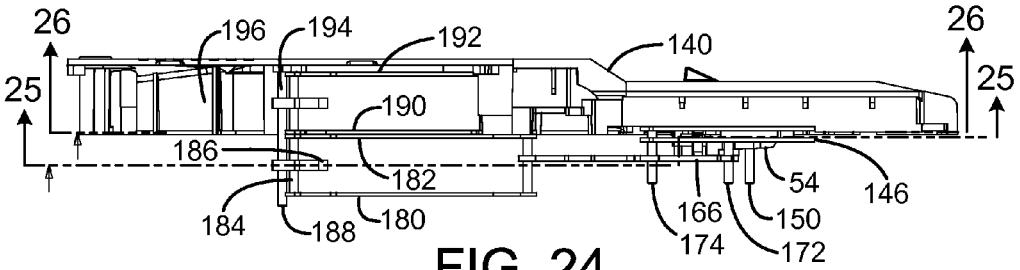
FIG. 24 is a top cutaway view of the current embodiment of the trigger assembly of FIG. 23 after the trigger has been pulled a second time and the left side shell has fired, resulting in both hammers being uncocked.
Figure 25:
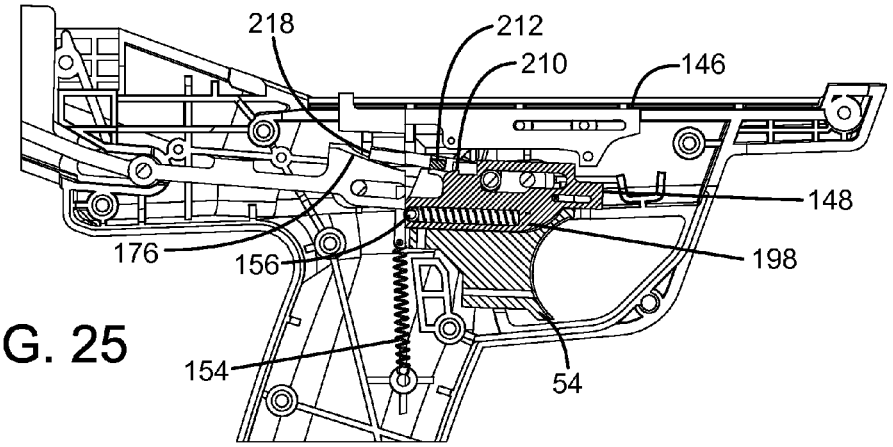
FIG. 25 is an enlarged partial view of the current embodiment of the trigger assembly of FIG. 23 taken along line 25 of FIG. 24.
Figure 26:
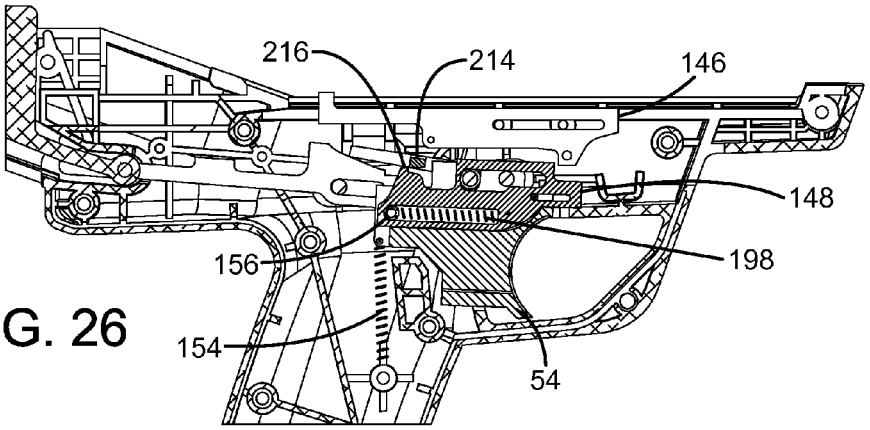
FIG. 26 is an enlarged partial view of the current embodiment of the trigger assembly of FIG. 23 taken along line 26 of FIG. 24 with the trigger lifting the left sear and the hammer trip ramps lifting the sears.

In FIGS. 11-14, the trigger assembly 138 of FIG. 10 is shown in the cocked and ready to fire position. The trigger assembly will cause only the shell 206 in the right chamber 114 to discharge responsive to the trigger 54 being pulled in this position. The trigger reset 146 compresses the selector bar spring 198 via the selector stop trigger pin 156, which positions the right hook 210 of the selector bar 148 under the right sear post 212. As a result, only the right sear 166 is lifted when the trigger is pulled, which allows only the right hammer 186 to fall on the right firing pin to discharge the shell 206 in the right chamber. As is shown in FIG. 14, there is clearance below the left sear post 214 in this position, so the left sear 168 is not lifted when the trigger is pulled.

In FIGS. 15-18, the trigger assembly 138 is shown in the position it assumes after the shell 206 and the right chamber 114 has discharged while the trigger 54 is pulled to its rearward stop. The right hammer trip moves forward, lifting the tail 218 of the right sear 166 with the right sloped surface 230. This will enable the selector bar spring 198 to urge the selector bar 148 forward under the right sear. The tail of the right sear is held up by the right hammer trip until the right hammer 186 is cocked again.

In FIGS. 19-22, the trigger assembly 138 is shown in the position it assumes after the trigger 54 is released and pulled back down by the trigger return spring 154. The trigger assembly will cause only the shell 206 in the left chamber 116 to discharge responsive to the trigger being pulled in this position. The selector bar 148 has been urged forward by the selector bar spring 198, and the right hook 216 of the selector bar has passed under the right sear post 212. The left hook 210 of the selector bar, which is located rearward of the right hook of the selector bar, is positioned under the left sear post 214. As a result, only the left sear 168 is lifted when the trigger is pulled, which allows only the left hammer 196 to fall on the left firing pin to discharge the shell 206 in the left chamber.

In FIGS. 23-26, the trigger assembly 138 is shown in the position assumes after the trigger 54 has been pulled a second time, the shell 206 and the left chamber 116 has discharged, and the trigger has been pulled back down by the trigger return spring 154. The selector bar 148 has been urged forward by the selector bar spring 198. The right and left hammer trips 176, 178 have lifted the right and left tails 218, 220 of the right and left sears 166, 168 with their sloped surfaces 230, 232. The forend release tail 222 is lifted by the left hammer trip to actuate the action release button 72 so the right and left forends 68, 70, which are connected, can be pulled rearward.

Figure 27:
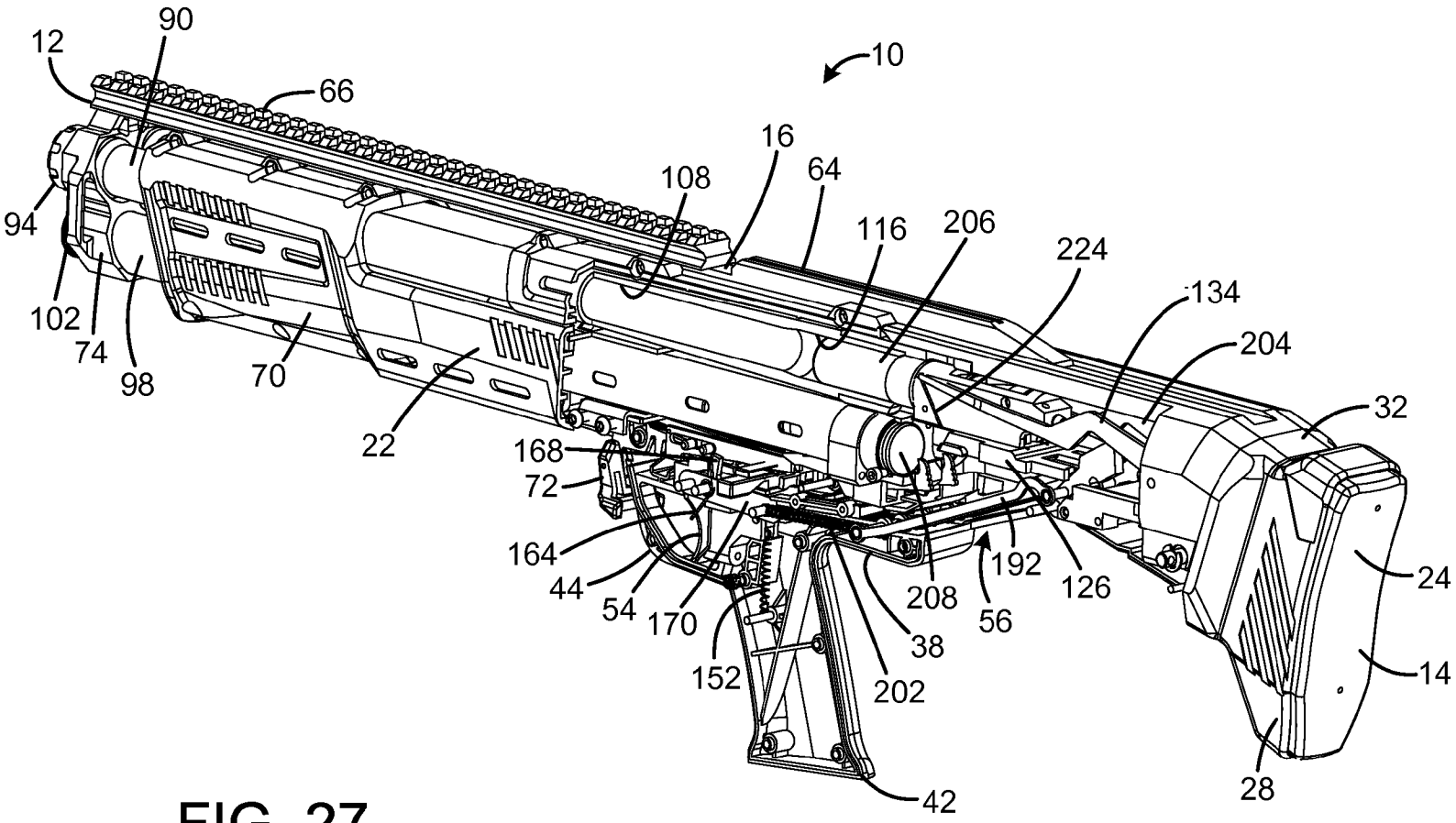
FIG. 27 is a rear isometric cutaway view of the current embodiment of the double-barreled bullpup pump-action shotgun of FIG. 1 with the bolt initiating extraction of the discharged shell.

In FIG. 27, the left rear of the shotgun 10 is cutaway. Both shells 206 received in the right and left chambers 114, 116 have been discharged. As the right and left forends 68, 70, which are connected, are pulled rearward, the right and left bolts 120, 122 move rearward and begin extracting the discharged shells from the chambers. A slanted surface 224 on the bolts lifts the right and left shell carriers 204, 134 upwards as the bolts move rearward. Extractors (not visible) on the bottom of the bolts pull the discharged shells rearward.

Figure 28:
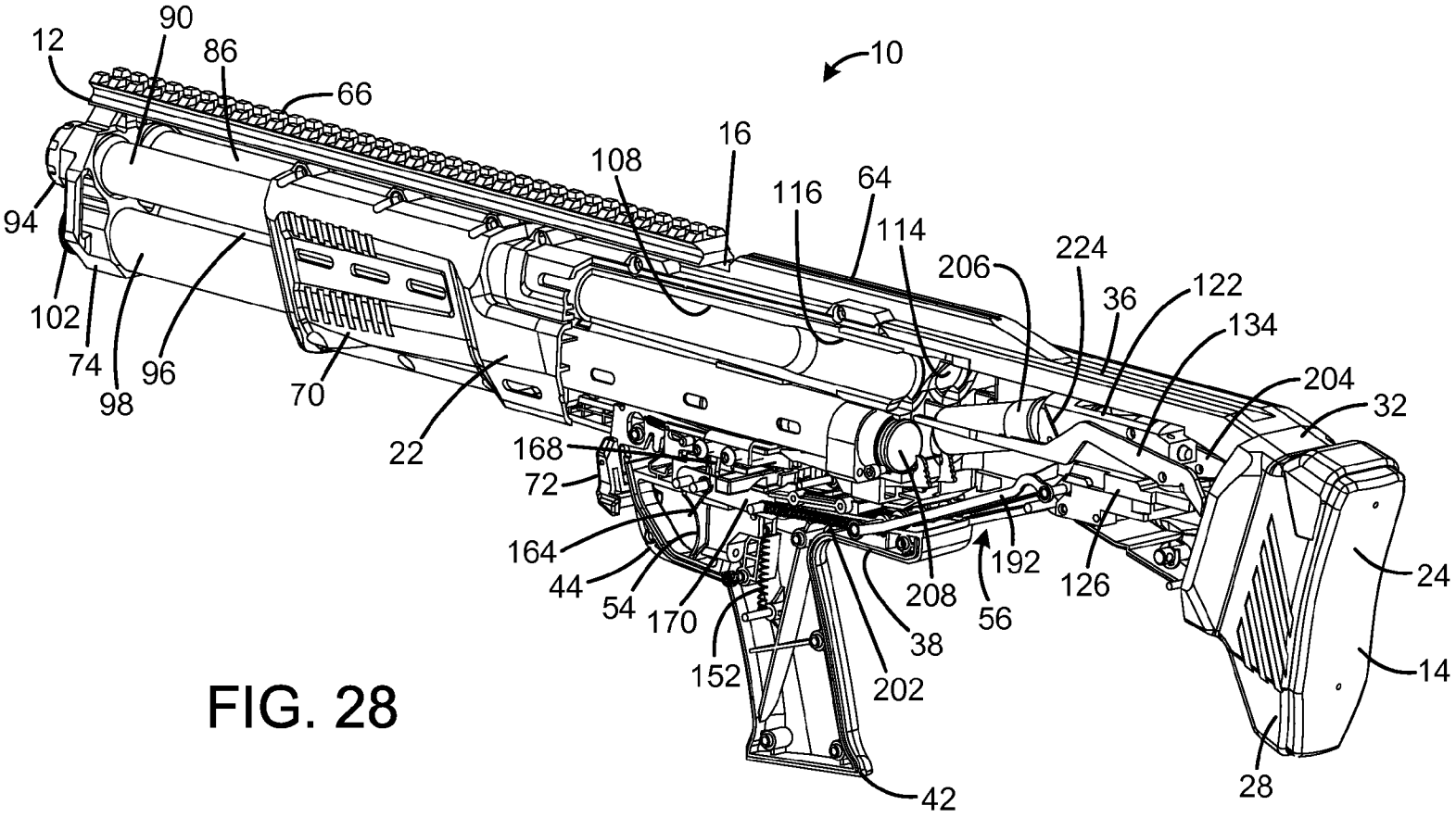
FIG. 28 is a rear isometric cutaway view of the current embodiment of the double-barreled bullpup pump-action shotgun of FIG. 1 with the carrier initiating ejection of the discharged shell.

In FIG. 28, the left rear of the shotgun 10 is cutaway. The right and left forends 68, 70, which are connected, have been pulled further rearward relative to FIG. 27. The right and left shell carriers 204, 134 are toggled by the right and left bolt slides 124, 126 to pivot downwards. The downward movement of the shell carriers pivots the discharged shells 206 downwards out of the extractors on the right and left bolts 120, 122.

Figure 29:
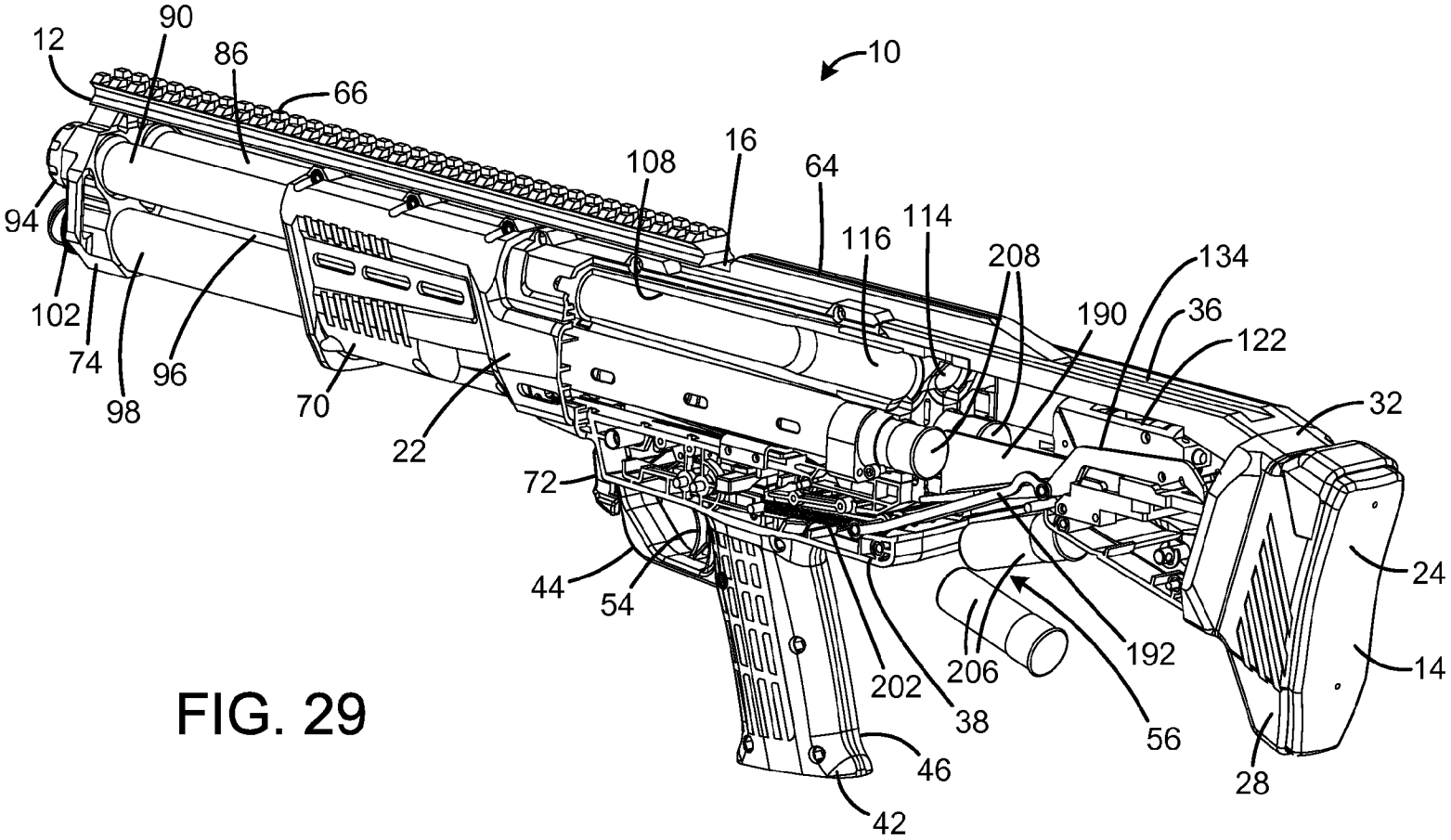
FIG. 29 is a rear isometric cutaway view of the current embodiment of the double-barreled bullpup pump-action shotgun of FIG. 1 with the discharged shells being ejected through the ejection port.

In FIG. 29, the left rear of the shotgun 10 is cutaway. The right and left forend 60, 70, which are connected, have reached their rearmost position. The discharged shells 206 are ejected downward through the right and left ejection ports 56, 58 by the right and left shell carriers 204, 134, which have moved further downward relative to FIG. 28. The shells 208 that will be loaded next begin to extract from the right and left magazine tubes 96, 98 above the shell carriers. The triangular-shaped hammer link divider 190 prevents the shells 208 from interacting with one another, which insures they will load smoothly.

Figure 30A:
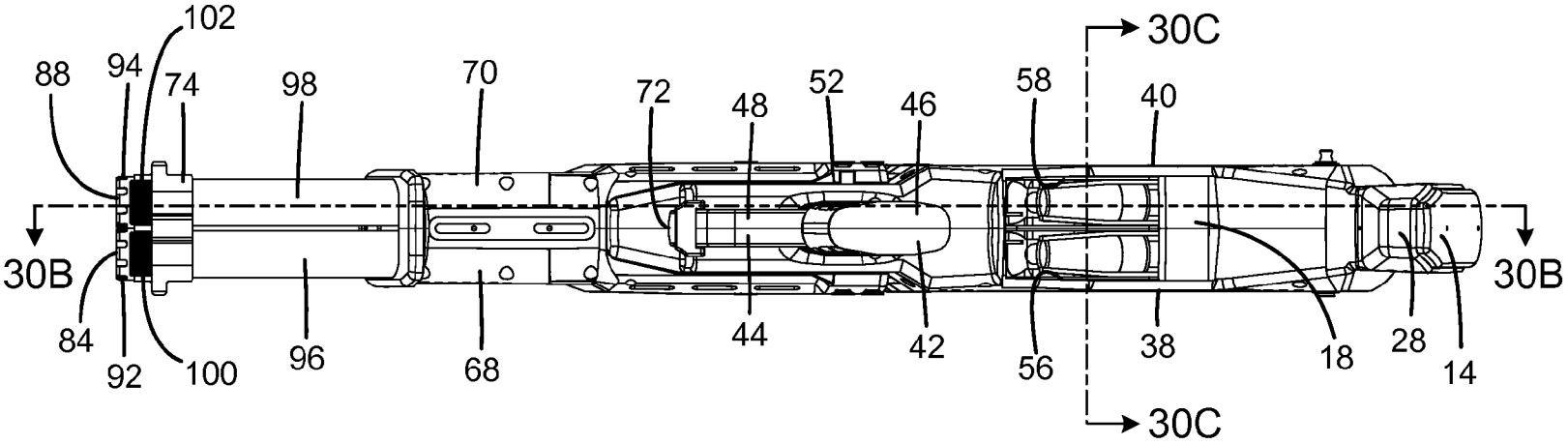
FIG. 30A is a bottom view of the current embodiment of the double-barreled bullpup pump-action shotgun of FIG. 1 with the next round from the magazine being lifted to the chamber.
Figure 30B:
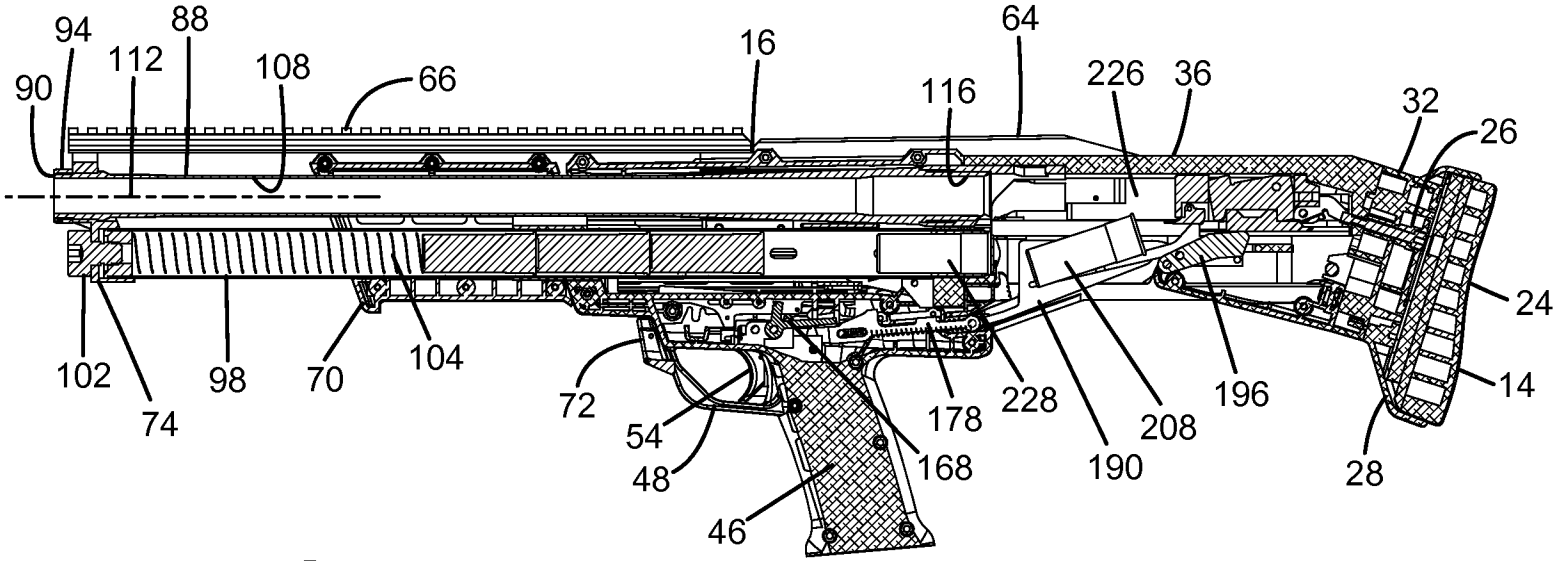
FIG. 30B is a sectional view of the current embodiment of the double-barreled bullpup pump-action shotgun of FIG. 1 taken along line 30B of FIG. 30A with the next round from the magazine being lifted to the chamber.
Figure 30C:
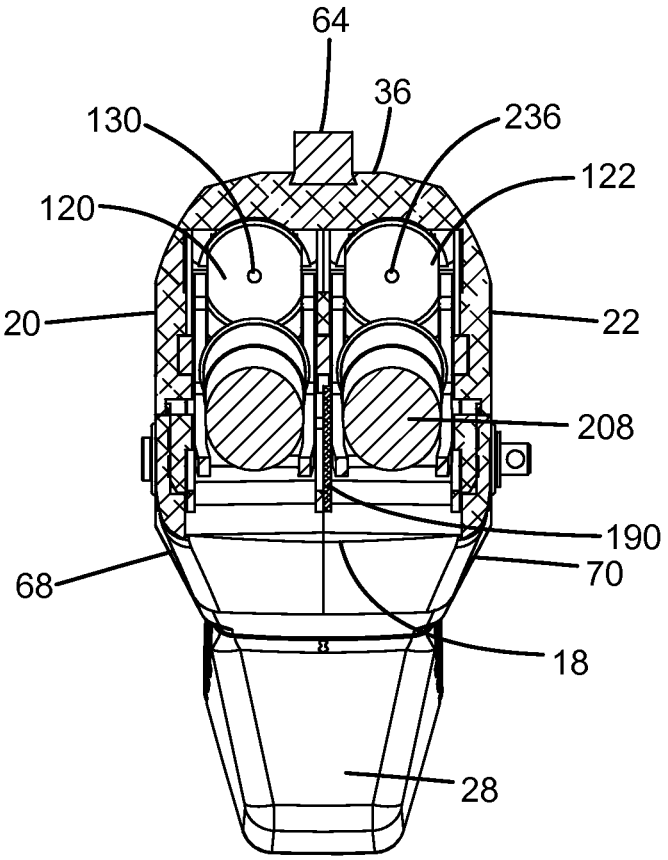
FIG. 30C is a sectional view of the current embodiment of the double-barreled bullpup pump-action shotgun of FIG. 1 taken along line 30C of FIG. 30A with the next round from the magazine being lifted to the chamber.

In FIGS. 30A-30C, the shells 208 that will be loaded next are lifted by the right and left shell carriers 204, 134 towards the right and left chambers 114, 116. A receiver divider wall 226 acts in conjunction with the hammer link divider 190 to prevent the shells 208 from interacting with one another, which insures they will load smoothly. One of the shells 228 that will load after the shells 208 are discharged is visible in the left magazine tube 98 in FIG. 30B. The right and left hammers 186, 196 have been cocked by the rearward movement of the right and left bolts 120, 122.

Figure 31:
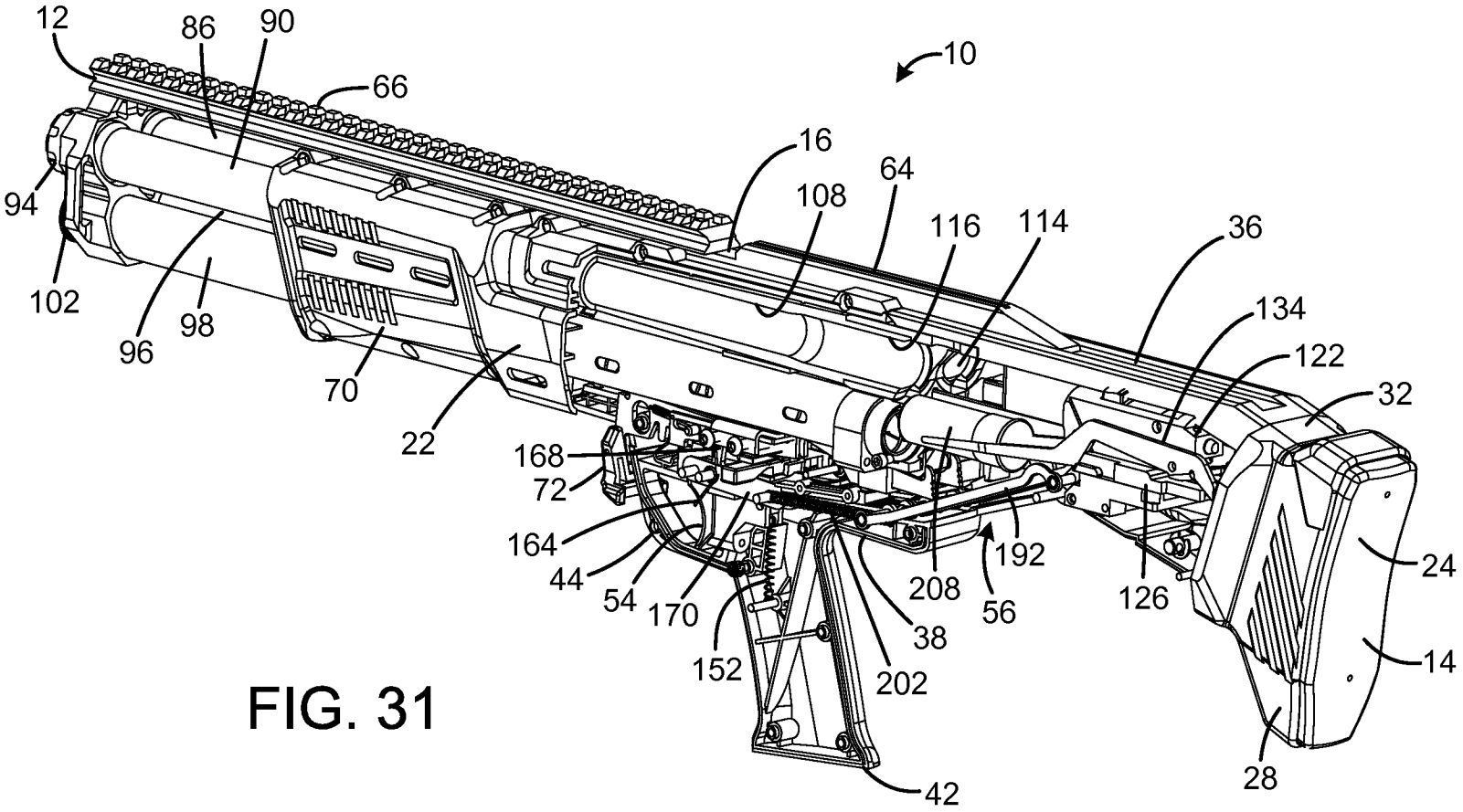
FIG. 31 is a rear isometric cutaway view of the current embodiment of the double-barreled bullpup pump-action shotgun of FIG. 1 with the next round from the magazine further lifted to the chamber.

In FIG. 31, the left rear of the shotgun 10 is cutaway. The right and left shell carriers 204, 134 are lifting shells 208 from the right and left magazine tubes 96, 98 up to the right and left chambers 114, 116 as the right and left forends 68, 70, which are joined, move forward from their rearmost position. The cycle continues with a return to the condition shown in FIG. 9.

While a current embodiment of a double-barreled bullpup pump-action shotgun has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a frame with two forward-extending barrels arranged side-by-side;

a pair of tube magazines, each positioned beneath a respective barrel;

an action attached to the frame and operable to load ammunition from the tube magazines to the barrels;

the action including a plurality of bolts, a plurality of hammers, and a plurality of shell carriers;

a trigger assembly attached to the frame;

the trigger assembly including a trigger;

wherein the action has a rear portion located behind the trigger; and wherein the trigger assembly includes a trigger linkage to connect the trigger assembly to the action and to operate the hammers positioned behind the bolts.

2. The firearm of claim 1 wherein the action is a pump action, including a plurality of forends that are pumped forward and backward to cycle the action to load an initial plurality of shells from the magazines into the barrels, eject a discharged plurality of shells from the barrels, and reload a second plurality of shells from the magazines.

3. The firearm of claim 1 wherein the trigger assembly includes a plurality of hammer trips, each having a sloped forward surface.

4. The firearm of claim 3 wherein the trigger assembly includes a plurality of sears having tails, and wherein the sloped surfaces of the hammer trips lift the tails of the sears during a portion of a complete cycle of the action.

5. The firearm of claim 4 wherein after one of the hammers has fallen responsive to actuation of the trigger assembly, the sloped surface of one of the hammer trips lifts the tail of one of the sears until the hammer that has fallen is cocked again.

6. The firearm of claim 5 wherein after both of the hammers has fallen responsive to actuation of the trigger assembly, the sloped surfaces of both of the hammer trips lifts the tails of both of the sears until both of the hammers that have fallen are cocked again.

7. The firearm of claim 1 wherein the trigger linkage includes an elongated hammer link extending from the trigger to the action, and wherein the hammer link has a broad panel portion that divides a space behind the plurality of barrels into two non-communicating portions and prevents interaction of a plurality of shells as they are loaded into the plurality of barrels.

8. The firearm of claim 1 wherein the barrels each have aft portions each having a cylindrical exterior surface portion having a first radius, and wherein the barrel axes are spaced apart by less than two times the first radius.

9. The firearm of claim 8 wherein at least one of the barrel aft portions defines a flat surface facing the other barrel.

10. The firearm of claim 8 wherein each of the barrel aft portions has a sidewall thickness of a first thickness amount at the cylindrical exterior surface portion, and a sidewall thickness of a lesser second thickness at a portion of the aft portion proximate the other barrel.

11. The firearm of claim 8 wherein each of the barrel aft portions has a flat surface portion, and wherein the flat surfaces face each other.

12. The firearm of claim 11 wherein the flat surface portions abut each other.

13. The firearm of claim 8 wherein the barrels are chambered for a 12 gauge shell, and wherein the barrel axes are spaced apart by an amount less than or equal to 1.100 inch.

14. The firearm of claim 2 wherein the bolts are operably connected to the action such that the bolts move simultaneously as the forends are pumped.

* * * * *